US007106353B2

(12) United States Patent
Shigeta

(10) Patent No.: US 7,106,353 B2
(45) Date of Patent: Sep. 12, 2006

(54) IMAGE DISPLAY APPARATUS AND METHOD OF DRIVING THE SAME

(75) Inventor: Kazuyuki Shigeta, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 515 days.

(21) Appl. No.: 09/888,606

(22) Filed: Jun. 26, 2001

(65) Prior Publication Data

US 2002/0030674 A1 Mar. 14, 2002

(30) Foreign Application Priority Data

Jun. 26, 2000 (JP) ..... 2000-191903
Dec. 29, 2000 (JP) ..... 2000-385834
Jun. 21, 2001 (JP) ..... 2001-188844

(51) Int. Cl.
*G09G 5/02* (2006.01)

(52) U.S. Cl. ..... 345/698; 348/455

(58) Field of Classification Search ..... 348/558, 348/630, 631, 672, 445; 345/204, 87, 89, 345/691, 698, 699

See application file for complete search history.

(56) References Cited

U.S. PATENT DOCUMENTS 5,534,940 A * 7/1996 Sato et al. ..... 348/556
5,640,214 A 6/1997 Florence ..... 348/743
5,734,436 A * 3/1998 Abe et al. ..... 348/564
5,929,925 A * 7/1999 Nakamura et al. ..... 348/556
5,990,971 A * 11/1999 Nakai et al. ..... 348/558
6,064,366 A * 5/2000 Millward et al. ..... 345/691
6,252,590 B1 * 6/2001 Sawai et al. ..... 345/667
6,367,080 B1 * 4/2002 Enomoto et al. ..... 725/112
6,377,369 B1 * 4/2002 Preston ..... 359/15
6,443,597 B1 * 9/2002 Natori ..... 362/304
6,486,900 B1 * 11/2002 Shen et al. ..... 345/867
6,535,688 B1 * 3/2003 Kawamura et al. ..... 386/95
2003/0112523 A1 * 6/2003 Daniell ..... 359/626

FOREIGN PATENT DOCUMENTS

JP 5-122633 5/1993
JP 5-153529 6/1993
JP 6-167952 6/1994
JP 6-202078 7/1994
JP 8-195963 7/1996
JP 9-322101 12/1997

* cited by examiner

*Primary Examiner*—Ricardo Osorio
(74) *Attorney, Agent, or Firm*—Fitzpatrick, Cella, Harper & Scinto

(57) ABSTRACT

An image display apparatus includes an image signal generating unit for generating an image signal and an image display element for displaying an image on a screen according to the image signal inputted from the image signal generating unit. When the screen is divided into a portion in which the image is to be displayed and a dark display portion in which no image is to be displayed, a non-dark display is performed in the dark display portion for a very short time period from a start time of display control until a start time of a process for terminating the display control.

14 Claims, 22 Drawing Sheets

| INPUT VALUE | OUTPUT VALUE |
|---|---|
| 0 | 0 |
| 1 | 1 |
| 2 | 2 |
| 3 | 3 |
| 4 | 4 |
| 5 | 5 |
| 6 | 6 |
| • | • |
| • | • |
| • | • |
| 58 | 58 |
| 59 | 59 |
| 60 | 60 |
| 61 | 60 |
| 62 | 60 |
| 63 | 60 |

FIG. 13A

| INPUT VALUE | OUTPUT VALUE |
|---|---|
| 0 | 0 |
| 1 | 1 |
| 2 | 2 |
| 3 | 3 |
| 4 | 4 |
| 5 | 5 |
| 6 | 6 |
| • | • |
| • | • |
| • | • |
| 58 | 58 |
| 59 | 59 |
| 60 | 60 |
| 61 | 61 |
| 62 | 62 |
| 63 | 62 |

FIG. 13B

IMAGE DISPLAY APPARATUS AND METHOD OF DRIVING THE SAME

BACKGROUND OF THE INVENTION

1. Field of the Invention

The present invention relates to an image display apparatus that displays various images and a method of driving the image display apparatus.

2. Related Background Art (1) Generally, display images have different aspect ratios (ratios between horizontal sizes and vertical sizes), depending on the types of image sources. The screen sizes (length-to-width ratios of screens) of image display apparatuses have conventionally been set so as to match the aspect ratios of images to be displayed. As shown in FIGS. 1A and 1B, however, there may be cases where the aspect ratios ($x_1$:$y_1$ and $x_1$:$y_3$) of screens do not match the aspect ratios ($x_2$:$y_1$ and $x_1$:$y_2$) of images. This problem is described in more detail below.

It is currently required that image display apparatuses display various types of images, such as television images and Internet images, that have different aspect ratios. FIG. 7A shows an example of an Internet image that is displayed on a personal computer screen and has an aspect ratio of $x_2$:$y_1$=4:3, while FIG. 7B shows an example of a television image that is displayed on the screen of a wide television set and has an aspect ratio of $x_1$:$y_2$=16:9.

It has conventionally been sufficient that image display apparatuses of television sets only display television images and image display apparatuses of personal computers only display specific images such as Internet images. That is, the aspect ratios of images to be displayed by image display apparatuses have been predetermined and the screen sizes (aspect ratios of screens) of the image display apparatuses have been set to match the aspect ratios of images to be displayed.

Recent advancements in the multimedia field, however, make image display apparatuses not only to display specific images but increases the opportunities for them to display images in various image signal formats. For instance, television sets (image display apparatuses) capable of displaying Internet images and conversely personal computers (image display apparatuses) capable of displaying television images are now on the market. These image display apparatuses are designed not only to display images having a fixed aspect ratio but to display images having various aspect ratios.

Also, there appear television images having various aspect ratios. That is, images broadcasted by terrestrial analog broadcast services have an aspect ratio of 4:3, while images broadcasted by satellite broadcast services or digital broadcast services have an aspect ratio of 16:9. This raises the possibility that even if image display apparatuses display only television images and do not display Internet images, images displayed by them vary in the aspect ratio.

As shown in FIGS. 1A and 1B, if images are displayed by image display apparatuses whose screen sizes do not match the aspect ratios of the images, the screen areas of the image display apparatuses are divided into two types of portions: portions $B_1$ (hereinafter referred to as "effective image areas $B_1$") where various images are displayed, and portions $B_2$ (hereinafter referred to as "non-effective image areas $B_2$") where no image is displayed and masks are applied. Note that FIG. 1A shows a state where an Internet image (aspect ratio=4:3) is displayed on an image display apparatus whose screen aspect ratio is 16:9, while FIG. 1B shows a state where an image (aspect ratio=16:9) is displayed on an image display apparatus whose screen aspect ratio is 4:3. In either case of these image display apparatuses, black masks are displayed in the non-effective image areas $B_2$.

(2) Image displays have conventionally been performed by sequentially scanning pixels that are capable of performing multi-level display and are arranged within display screens, although there appear on the market display apparatuses adopting a different display method where image display (multi-level gradation display) is performed by performing time divisional display of each display value subjected to a pulse width modulation (PWM) using pixels for binary display.

FIG. 2 shows an example construction of an image display apparatus (projection-type display apparatus using a mono-plate scheme) that performs the time divisional display. Here, the term "mono-plate scheme" means a method of displaying images in each color (such as, red (R), green (G), and blue (B)) using a single spatial modulation element (image display element). This method simplifies optical systems and electric circuit systems and therefore is suitable for realizing a low-cost and lightweight display unit.

An image display apparatus 1 in FIG. 2 includes a binary-display-type image display element 2, such as an MEMS (micro-electromechanical systems) spatial modulation element. The image display element 2 is also of a reflection type and reflects light. On the side, toward which the image display element 2 reflects light, are arranged a screen 4, on which images are to be projected, and an optical system 5 for projecting reflection light (light that has been spatially modulated by the image display element 2 and includes display information) onto the screen 4. Note that reference numeral 50 represents a lens.

A lighting device 3 is provided with a metal halide lamp 30 that emits white light using power supplied by a ballast power source 31. A disc-like rotary color filter 32 is disposed between the lamp 30 and the image display element 2 so as to be freely rotated and the color filter 32 is structured so as to be rotated and driven by a filter driving unit 33. Here, as shown in FIG. 8, the color filter 32 is divided into three color regions 32R, 32G, and 32B. Light in three colors (red, green, and blue) is sequentially irradiated onto the image display element 2 according to the rotation of the color filter 32.

Note that reference numeral 34 indicates a lens disposed between the color filter 32 and the lamp 30, and numeral 35 indicates a lens disposed between the color filter 32 and the image display element 2.

Also, reference numeral 7 represents an input unit for inputting image signals. Further, reference numeral 8 denotes a signal processing unit that processes the inputted image signals by adjusting image quality (such as brightness, color characteristics, and gamma characteristics) of the inputted image signals and converting the adjusted image signals into PWM-modulated time divisional signals that are appropriate for the driving method of the display element. The signal processing unit 8 also generates a driving pulse for the display element, a control signal for a motor, and the like. Reference numeral 8*a* indicates a data bus that transmits the time divisional signals to the display element, and numeral 8*b* indicates a control line that transmits the driving pulse to the display element.

According to these signals from the signal processing unit 8, the image display element 2 sequentially displays images in synchronization with light irradiation. In this manner, images in different colors are sequentially displayed on the screen 4, on which these images are mixed visually and are recognized as full-color images by viewers.

The construction of the signal processing unit 8 stated above is described in more detail below with reference to FIG. 9. Here, FIG. 9 is a block diagram showing the detailed construction of the signal processing unit 8.

In this drawing, an input unit 7 for inputting various image signals includes an input terminal 71 for inputting an image signal, an input terminal 72 for inputting a horizontal synchronizing signal (IHD) among the input signals, an input terminal 73 for inputting a vertical synchronizing signal (IVD) among the input signals, and an input terminal 74 for inputting a clock signal (ICLK) among the input signals.

In this drawing, reference numerals 711, 712, 713, and 714 each represent a data bus for transmitting these image signals. Reference numeral 721 indicates a signal line for transmitting the horizontal synchronizing signal (IHD) among the input signals, numeral 731 indicates a signal line for transmitting the vertical synchronizing signal (IVD) among the input signals, and numeral 741 indicates a signal line for transmitting the clock signal (ICLK) among the input signals.

Reference numeral 80 denotes an image input unit. In more detail, the image input unit 80 is an image signal receiving unit. For instance, the image input unit 80 includes a decoder that receives a signal based on a TMDS scheme and decodes the received signal into 24-bit data (three pieces of 8-bit data corresponding to respective colors (R, G, and B)). Here, the TMDS scheme is an image transmission scheme adopted by, for instance, a DVI (Digital Visual Interface) specification published by a standardizing group "DDWG (Digital Display Working Group)". Alternatively, the image input unit 80 includes a decoder that receives a compression signal in an MPEG format via IEEE 1394 and decodes the received compression signal into 24-bit data (three pieces of 8-bit data corresponding to respective colors (R, G, and B)).

Reference numeral 81 represents a format conversion unit that performs resolution conversion, image refresh frequency conversion, non-interlace processing, color matrix conversion, and the like. Here, the resolution conversion means magnification conversion and interpolation processing that are appropriately performed for an image signal whose resolution does not match the number of display pixels of the image display unit. Also, reference numeral 82 represents a memory unit that provides an image storage area used by the format conversion unit to perform the image processing. Reference numeral 82*a* indicates a control line group of the memory unit, and numeral 82*b* indicates a data line group for transferring data between the memory unit and the format conversion unit. Reference numeral 83 denotes a crystal oscillator. According to the clock signal (OCLK) generated by the crystal oscillator, the format conversion unit 81 generates a horizontal synchronizing signal (OHD) and a vertical synchronizing signal (OVD), which are used to establish synchronization after the format conversion processing, under the control by a microcomputer unit (not shown). Reference numeral 811 indicates a signal line for transmitting the horizontal synchronizing signal (OHD), numeral 812 indicates a signal line for transmitting the vertical synchronizing signal (OVD), and numeral 813 indicates a signal line for transmitting the clock signal (OCLK) generated by the crystal oscillator.

Reference numeral 84 represents an image quality adjusting unit that receives the image signal subjected to the format conversion and adjusts image quality, such as brightness, color characteristics, and gamma characteristics, of images to be displayed on the display unit, according to the control by the microcomputer (not shown).

Reference numeral 85 indicates a PWM conversion unit for converting an ordinary image signal for sequential scanning into a time divisional display signal by performing the pulse width modulation (PWM), numeral 86 indicates a time divisional sequence storage unit for storing time divisional drive sequence data describing the display order and display time period of the PWM-modulated data, numeral 87 indicates a PWM driving timing generating unit for generating, according to the time divisional drive sequence, driving timing used by the PWM conversion unit 85 and the spatial modulation element (image display element) that is an image display unit. Reference numeral 861 denotes a transmission line for transmitting the drive sequence data from the time divisional drive sequence storage unit 86 to the PWM drive timing generating unit 87, and numeral 871 indicates a control line group for transmitting a driving pulse generated by the PWM driving timing generating unit 87 and other signals. Also, reference numeral 872 represents an output terminal via which control signals, such as the driving pulse, are outputted to the image display element 2, numeral 851 a data bus for transmitting the image data converted by the PWM conversion unit 85, and numeral 852 indicates an output terminal via which the image data is outputted to the image display element 2.

The PWM drive timing generating unit 87 generates the control signal for the PWM conversion unit 85 and the driving pulse for the display element according to the sequence data in the time divisional sequence storage unit 86. That is, the image inputted into the signal processing unit is subjected to appropriate format conversion and image quality adjustment and then is converted into the time divisional drive signal by the PWM conversion unit 85. The PWM conversion unit 85 and the display element are driven in synchronization with each other.

FIG. 10 shows an example of the display data sequence that has been PWM-modulated by the PWM conversion unit 85. In this drawing, the horizontal axis represents time and reference numeral 201 denotes a start pulse designating the start of image display in each color (R, G, and B) within one field. Reference symbol FR indicates a time period during which red display is performed, reference symbol FG indicates a time period during which green display is performed, and reference symbol FB indicates a time period during which blue display is performed. In this specification, a time period composed of one FR period, one FG period, and one FB period is referred to as one field period.

Also, reference symbols DR1–DR6 represent display data in red that has been PWM-modulated. Here, for ease of explanation, the display data is expressed as 6-bit signal, with reference symbol DR1 representing the first-bit signal, reference symbol DR2 the second-bit signal, reference symbol DR3 the third-bit signal, reference symbol DR4 the fourth-bit signal, reference symbol DR5 the fifth-bit signal, and reference symbol DR6 the sixth-bit signal. The pulse length of each bit signal is twice as long as that of the next lower bit signal. For instance, the length of the second-bit signal DR2 is twice as long as that of the first-bit signal DR1 and the length of the third-bit signal DR3 is twice as long as that of the second-bit signal DR2. According to the image data inputted by the PWM conversion unit 85, each bit is selected so that the pulse width matches the gradation value of the image data. In this manner, a time series ON/OFF signal subjected to the pulse width modulation is obtained. According to this ON/OFF signal, each pixel of the image display element 2 is placed in one of the binary states. By performing light reflection in one of the binary states, an image in red is displayed within one field period according to the integral in the FR period.

Reference symbols DG1–DG6 represent display data in green that has been PWM-modulated, and reference symbols DB1–DB6 represent display data in blue that has been PWM-modulated. In either case of green display data and blue display data, the pulse length of each bit signal is twice as long as that of the next lower bit signal. According to the image data inputted by the PWM conversion unit 85, a signal having a pulse width corresponding to the gradation value of the image data is generated. The image display element 2 is driven and light reflection is controlled according to the signal subjected to the pulse width modulation. Images in green and blue are displayed within one field period according to the integral value in the FG period and the integral value in the FB period.

In this manner, a full-color image in one field is displayed according to the integral in each color period in one field.

As described above, image (gradation) display in the effective image areas $B_1$ is performed by placing each pixel of the image display element 2 in one of binary display states according to a pulse train that has been PWM-modulated based on the gradation value of image data in each color. (Here, in this specification, a state where light is reflected is referred to as an "ON state" and a state where light is not reflected is referred to as an "OFF state".) That is, image display is performed according to the integral of one of binary display states. Consequently, as distinct from an analog gradation TFT liquid crystal, the state of each pixel of such a binary-type image display element is switched between the ON state and OFF state in one field period even during still image display.

On the other hand, no image is basically displayed in the non-effective image areas $B_2$, so that each pixel in these areas $B_2$ of the binary image display element 2 is continuously placed in the OFF state and dark display is performed. In this example where display data is expressed as 6-bit signal, the dark display corresponds to a situation where each of RGB (red, green, and blue) has shade 0 among 64 (0–63) shades of gray scale.

It should be noted here that an example measure against hinge storage (to be described later) is disclosed in Japanese Patent Application Laid-open No. 08-195963.

Also, Japanese Patent Application Laid-open No. 09-322101 discloses a measure against image burn-in (to be described later). This patent application discloses a measure against image burn-in on a CRT caused by still image display. With this technique, the input current into the fluorescent surface of the CRT is maintained basically constant during both of display time periods and non-display time periods.

Another conventional technique of preventing image burn-in is disclosed in Japanese Patent Application Laid-open No. 5-153529. This patent application discloses a technique of achieving a liquid crystal display panel, which is easy to view, and of preventing image burn-in on the display panel. In particular, with this technique, white display is performed in side panel areas of the liquid crystal display panel for a predetermined time period before a display operation is stopped.

Japanese Patent Application Laid-open No. 5-122633 discloses still another conventional technique of reducing a brightness unevenness in non-image areas occurring when an image whose aspect ratio is 4:3 is displayed on a wide aspect television set. With this conventional technique, if non-image areas are generated on the screen of a cathode ray tube due to the display of a 4:3 image, light emission is performed in the non-image areas for a time period before the system is turned off, with the time period being determined according to the display time period of the image signal whose aspect ratio is 4:3.

SUMMARY OF THE INVENTION

The problem to be solved by the prevent invention is to realize a construction of an image display apparatus that suitably suppresses the degradation of the image display apparatus caused when the screen of the image display apparatus is divided into an area in which images are displayed and an area in which no image is displayed.

In effective image areas $B_1$ on a binary device, the state of each pixel of an image display element is continuously switched between the ON state and the OFF state according to an image signal. In non-effective image areas $B_2$, however, the state of each pixel remains in the OFF state, which becomes a cause of the degradation of the image display element. In particular, in the case of an MEMS element that is a binary device performing image display according to the stated time divisional drive scheme, an operation unit that operates by means of micromechanics is mechanically degraded or altered. Also, the operation unit suffers from mechanical malfunctions caused by the changes in mechanics relation with an electrostatic power. For instance, as described in Japanese Patent Application Laid-open No. 8-195963, this phenomenon is known as "hinge storage" in the case of the Texas Instrument's DMD. Such a phenomenon lowers the reliability and image quality of a display element and therefore becomes a critical problem for an image display apparatus adopting the time divisional drive scheme.

It should be noted here that a situation where there is a difference in aspect ratio (to be precise, a situation where the aspect ratio of a display image differs from that of a screen) is not the sole cause of the non-effective image areas $B_2$ (dark display portions) on a screen. For instance, if a plurality of subscreen areas are generated on a single screen, non-effective image areas $B_2$ are generated between the subscreen areas.

Also, in addition to the case of monochrome image display, the stated problem similarly arises in the case of full color image display. That is, even in the case where a full color image is displayed, non-effective image areas are generated in some cases. If the non-effective image areas remain in an OFF state for a long time, this also causes the problem stated above.

An object of the present invention is therefore to provide an image display apparatus that is resistant to the stated degradation and image burn-in.

Another object of the present invention is to provide a method of driving an image display apparatus without causing the stated degradation and image burn-in.

An invention disclosed in this specification is constructed as follows.

That is, according to the present invention, there is provided an image display apparatus including an image signal generating unit for generating an image signal and an image display element for displaying an image on a screen according to the image signal inputted from the image signal generating unit, characterized in that when the screen is divided into a portion in which the image is displayed and a dark display portion in which no image is displayed, non-dark display is performed in the dark display portion for a very short time period from a start time of display control until a start time of a process for terminating the display control.

Here, the start time of the display control means a time when power supply to the image display element is started to drive the element. Also, the start time of the process for terminating the display control means earlier one of (a) a start time of control for terminating power supply to the image signal generating unit for image display control and (b) a start time of control for terminating the power supply to the image display element for driving the element. For instance, a time when an OFF signal is supplied from a timer or a time when a user designates the termination of an operation state by pushing a button corresponds to the start time of the process for terminating the display control.

According to the present invention, the image display apparatus may suitably adopt a construction where the image display element includes a plurality of modulation target units that are two-dimensionally arranged. For instance, a liquid crystal device may be used and arranged as the image display element. In this case, a plurality of modulation target units, each of which includes one liquid crystal cell, are two-dimensionally arranged. Alternatively, like the Texas Instrument's DMD, the image display element may have a construction where micromirrors are used as the modulation target units. Further, a device of a self light emitting type, such as an LED element or a plasma display panel, may be used as the image display element.

In each of the above-mentioned inventions, the image display apparatus may suitably adopt a construction where the image display element performs binary display.

Also, the image display apparatus may suitably adopt a construction where the non-dark display is an image reversal.

Further, the image display apparatus may suitably adopt a construction where the non-dark display is performed a plurality of times from the start time of the display control until the start time of the process for terminating the display control. Here, if one non-dark display operation is performed for a long time period, this makes viewers feel visual interferences. Therefore, by repeatedly performing a non-dark display operation for a very short time period, the degradation is suitably suppressed, with viewers rarely feeling visual interferences. As described later, it is preferable that the effective time of one non-dark display operation is set at 4 ms or less. Also, it is suitable that the total effective time of the non-dark display repeatedly performed accounts for 20% or less of an entire display period. Here, the image display apparatus may suitably adopt a construction in which the non-dark display is cyclically performed a plurality of times. Also, the image display apparatus may suitably adopt a construction where the non-dark display is performed each time several field periods have passed. In particular, the image display apparatus may suitably adopt a construction where when images are displayed by sequentially irradiating the image display element with light in various colors and switching images in the colors displayed by the image display element in synchronization with the light irradiation, the non-dark display is performed in a display period assigned to a specific color.

It should be noted here that with the stated constructions, dark display is performed in a portion where no images are substantially formed, and non-dark display is performed for a very short time period during the dark display. However, if bright display is performed in a portion where gradation display is not performed, non-bright display may be performed for a very short time period during the bright display. This construction is particularly effective for a case where an MEMS element is used as the image display element. That is, if some of modulation target units (micromirrors) of the MEMS element do not perform gradation display and are placed in a bright state, the modulation target units remain in the bright (ON) state during a blanking period. In this case, the stated setting of the very short time period and the like may be suitably combined with the construction where non-bright display is performed for a very short time period in an area in which gradation display is not performed and therefore bright display is performed.

Also, this specification contains the following invention concerning a method of driving an image display apparatus.

A method of driving an image display apparatus that displays an image by inputting an image signal generated by an image signal generating unit into an image display element, the driving method including: a step for displaying a multi-level gradation image in a predetermined area of a screen and performing dark display in another predetermined area of the screen, and a step for performing non-dark display in the other predetermined area for a moment from a start time of display control until a start time of a process for terminating the display control.

Further, this specification contains the following invention.

An image display apparatus including an image signal generating unit for generating an image signal and an image display element for displaying images on a screen by performing bright display and dark display according to the image signal inputted from the image signal generating unit, characterized in that when the screen is divided into an effective image area in which various images are displayed while a non-effective image area in which no image is displayed, dark display is continuously performed and bright display is performed for a very short time period in the non-effective image area.

The stated constructions and methods may be combined with one another.

BRIEF DESCRIPTION OF THE DRAWINGS

FIG. 13A shows a look-up table for image display element protection;

FIG. 13B shows a look-up table for the image display element protection;

DESCRIPTION OF THE PREFERRED EMBODIMENTS

Embodiments of the present invention are described below with reference to the drawings.

In the effective image areas $B_1$ described in the section "Related Background Art" of this specification, the state of each pixel of the image display element is continuously switched between the ON state and the OFF state according to image signals. In the non-effective image areas $B_2$, however, the state of each pixel always remains in the OFF state constantly, which becomes a cause of the degradation of the image display element. In particular, in the case of MEMS element that is a binary device performing image display according to the time divisional drive scheme described above, the operation unit that operates by means of micromechanics is mechanically degraded or altered. Also, such an operation unit suffers from mechanical malfunctions caused by the changes in mechanics relation with an electrostatic power. For instance, as described in Japanese Patent Application Laid-open No. 8-195963, this phenomenon is known as "hinge storage" in the case of the Texas Instrument's DMD. Also, in the case of a ferroelectric liquid crystal panel that is also a binary device, image burn-in tends to occur due to long-term signal differences, such as voluntary polarization. Further, the image burn-in phenomenon similarly occurs for a device of a self light emitting type, such as an LED element or a plasma display panel. Such a phenomenon lowers the reliability and image quality of a display element and becomes a critical problem for an image display apparatus adopting the time divisional drive scheme.

Also, even if image burn-in prevention control is performed only when an image display apparatus is turned off, the opportunity to perform the image burn-in prevention control is limited.

In the following embodiments, there are described image display apparatuses, where the above-stated degradation and image burn-in are effectively suppressed, and a driving method for such image display apparatuses.

An embodiment mode of the present invention is described below with reference to FIGS. 1A, 1B, 2, 4, and 6.

Figure 2:
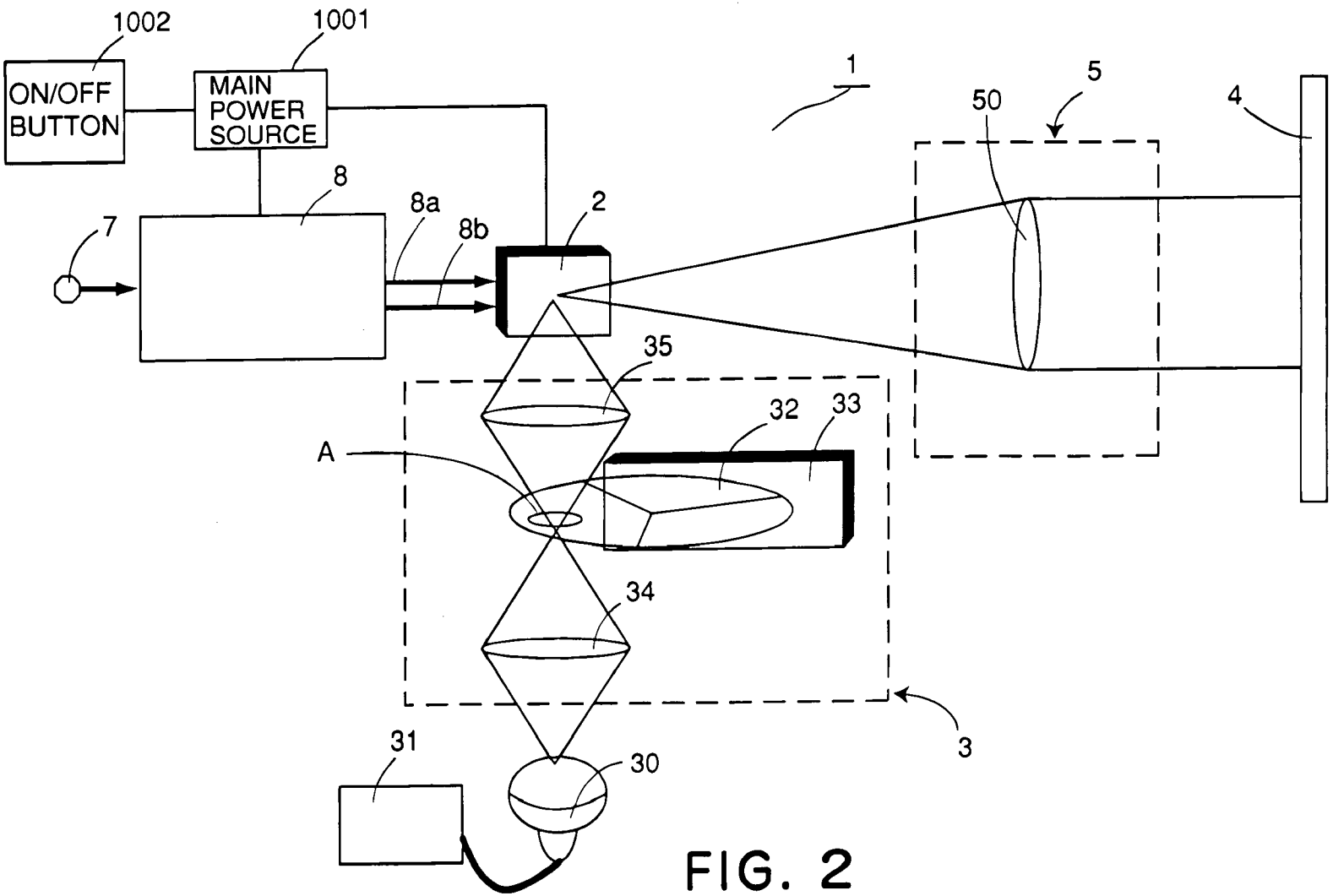
FIG. 2 (PRIOR ART)
FIG. 2 shows an example construction of an image display apparatus (a mono-plate projection-type display apparatus)

The present invention is applied to the image display apparatus 1 shown in FIG. 2. As shown in this drawing, an image display apparatus 1 includes an image signal generating unit 8 for generating an image signal and an image display element 2 that displays images on a screen according to the image signal inputted from the image signal generating unit 8.

Figure 14:
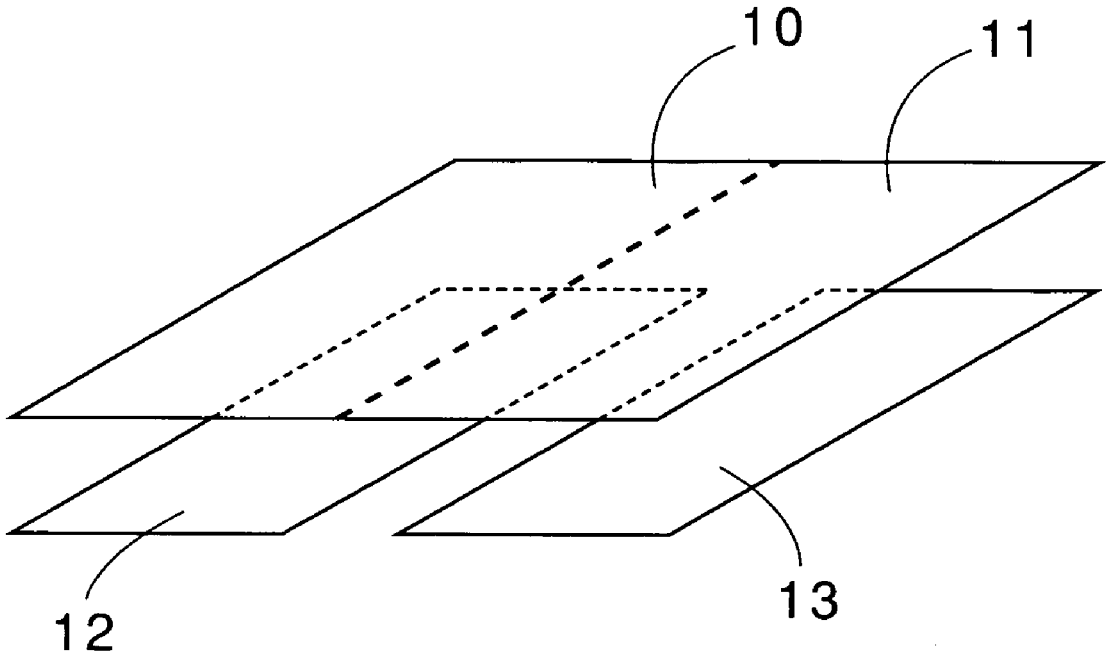
FIG. 14 is a perspective view showing the outline of the construction of an MEMS element.

Here, any image display element may be used as the image display element 2 as long as image display is performed using bright/dark display states (binary display states). An example of such is a spatial modulation element of an MEMS (micro-electromechanical systems) type. An example of the MEMS spatial modulation element is an element, such as the Texas Instrument's DMD device, that has a construction shown in FIG. 14 where each pixel is provided with a micromirror 11 that is supported by a shaft so as to be freely swung. In the spatial modulation element, the micromirror 11 is made of a conductive material. Also, electrodes 12 and 13 are disposed so as to oppose the mirror 11. The position of the mirror 11 is changed as follows.

Figure 15A:
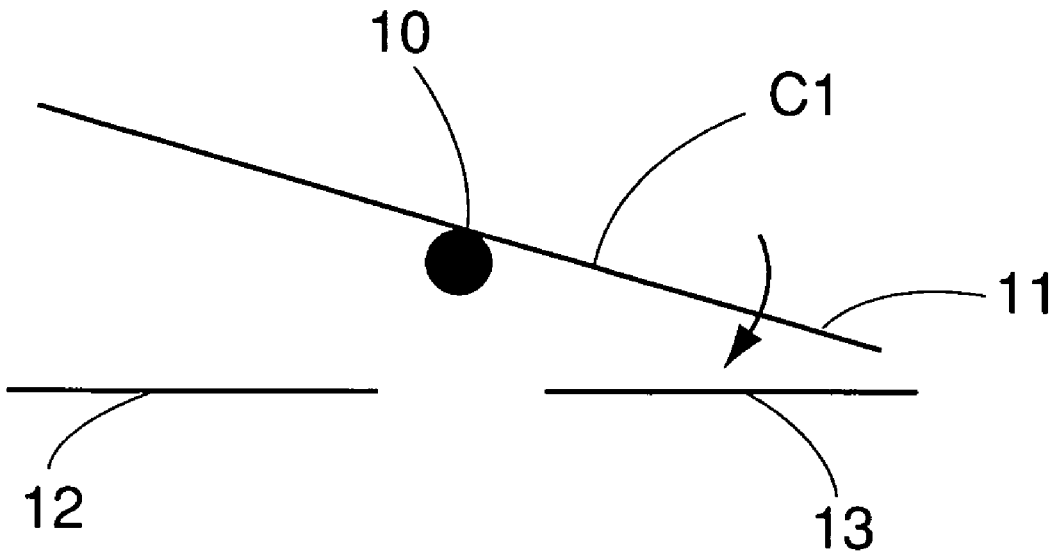
FIGS. 15A and 15B are perspective views showing the operation of the MEMS element.

If the voltage between the mirror 11 and the electrode 13 is higher than that between the mirror 11 and the electrode 12, the mirror 11 is rotated clockwise and is set in a first position Cl shown in FIG. 15A.

Figure 15B:
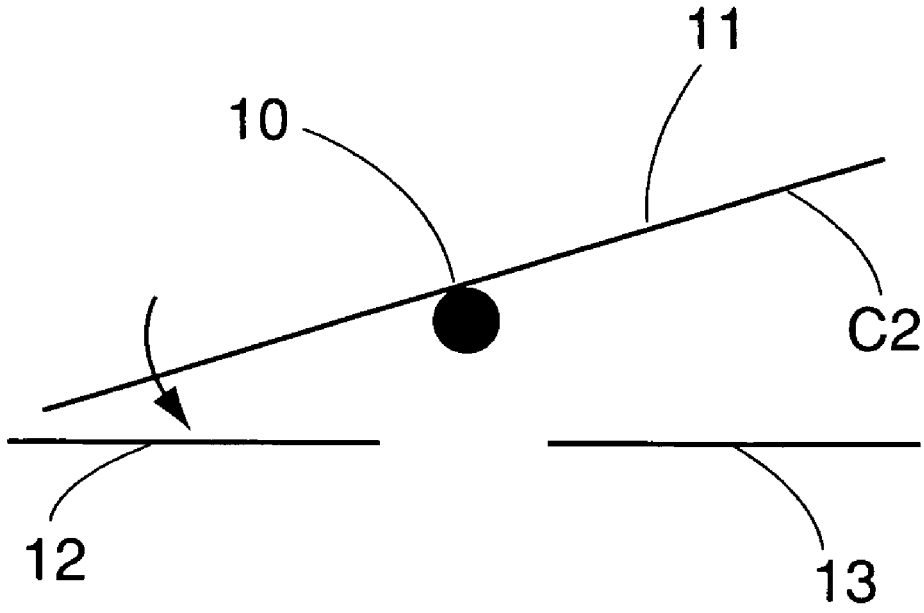

If the voltage between the mirror 11 and the electrode 12 is higher than that between the mirror 11 and the electrode 13, the mirror 11 is rotated counterclockwise and is set in a second position C2 shown in FIG. 15B.

Figure 16A:
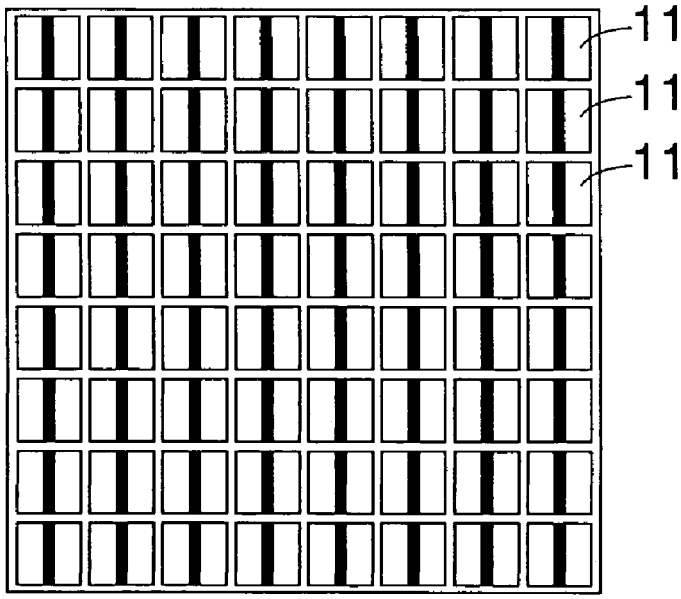
FIGS. 16A and 16B show example outside shapes of the MEMS element.
Figure 16B:
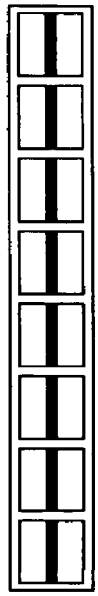

An ordinary example of the image display element 2 is a wide-shaped (rectangular) element where pixels are consecutively arranged vertically and horizontally, as shown in FIG. 16A. Another ordinary example is a narrow and long element where pixels are consecutively arranged only in one direction, as shown in FIG. 16B. Note that in FIG. 16B, the element includes only one row of pixels, although a plurality of pixel rows may be provided as long as the shape of the element is narrow and long.

Figure 17A:
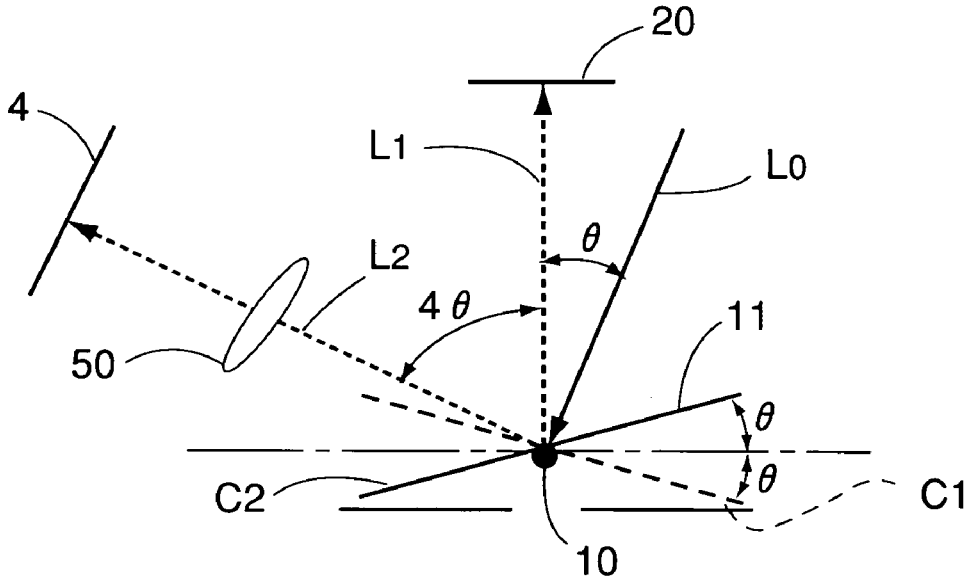
FIGS. 17A and 17B show the operation and the like of the MEMS element.
Figure 17B:
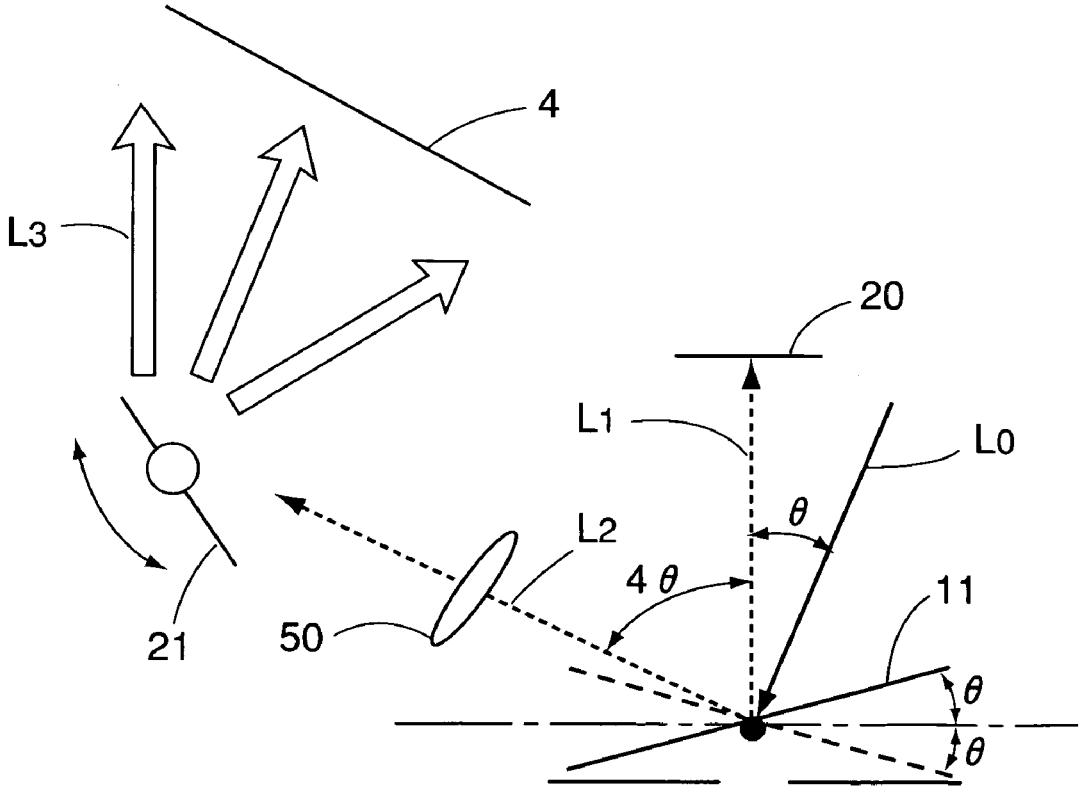

It does not matter whether the image display element has the shape shown in FIG. 16A or the shape shown in FIG. 16B, as long as a lighting device 3 emits light toward the image display element 2, as shown in FIG. 2 (see reference symbol $L_0$ in FIGS. 17A and 17B).

In each pixel whose micromirror 11 is set in the first position C1, light is reflected toward a light absorber 20 and dark display is performed, as indicated by reference symbol $L_1$ (see FIGS. 17A and 17B).

In each pixel whose micromirror 11 is set in the second position C2, light is reflected so that bright display is performed, as indicated by reference symbol $L_2$ (see FIGS. 17A and 17B).

Here, in the case of the apparatus shown in FIG. 17A, image display is performed only by projecting reflection light $L_2$ from the mirror 11 onto a screen 4 through a projection lens 50. However, in the case of the apparatus shown in FIG. 17B, it is required to scan the light to be projected onto the screen 4. In this drawing, a scanning means 21 is disposed on the optical path of the light $L_2$ reflected by the micromirror 11 so as to scan light $L_3$ onto the screen 4. Here, any other light scanning method may be used.

In either case of these apparatuses, image display is performed by setting the mirror 11 provided for each pixel in the first position C1 or the second position C2.

Also, in this embodiment mode, the screen area of the image display element 2 is divided into an effective image area $B_1$ and a non-effective image area $B_2$. In the effective image area $B_1$, various images are displayed. In the non-effective image area $B_2$, however, dark display is continuously performed without displaying any image, and bright display is also performed for a very short time period during the dark display. Note that it is preferable that the total of effective times of bright display (non-dark display) occupies a portion exceeding 0% but not exceeding 20% of the entire display time period during which images are substantially displayed in the effective image area (in which image display is performed). Also, it is preferable that the effective time of one non-dark display operation is set not to exceed 4 ms. Here, "the effective time of one non-dark display operation" means the total of time periods during which at least one pixel in the non-effective image areas (dark display areas) is placed in the non-dark state within one image display refresh cycle. The proportion of the total effective time of non-dark display to the entire display time period may be reduced by decreasing the number of fields in which non-dark display is performed. This is effective at implementing the present invention, although attention needs to be paid to the point described below. The following description is based on the assumption that one field time period is set as 17 ms. Even if the proportion of the total effective time of non-dark display to the entire display time period is reduced by using the entire one field time period as an effective time of non-dark display and by refraining from performing the non-dark display in the following four fields, this makes viewers feel some visual interferences. By reducing the effective time of one non-dark display operation to 4 ms or less, however, the visual interferences felt by viewers can be suitably suppressed. On the other hand, even in the case where the effective time of one non-dark display operation is set at 4 ms or less, if one field time period is set at 10 ms and one non-dark display operation with the effective time of 4 ms is performed in each field, a black mask is conspicuously brightened. Accordingly, it is preferable that the effective time of one non-dark display operation is set at 4 ms or less and the total effective time of non-dark display is set to account for 20% or less of the entire display time period.

Figure 1A:
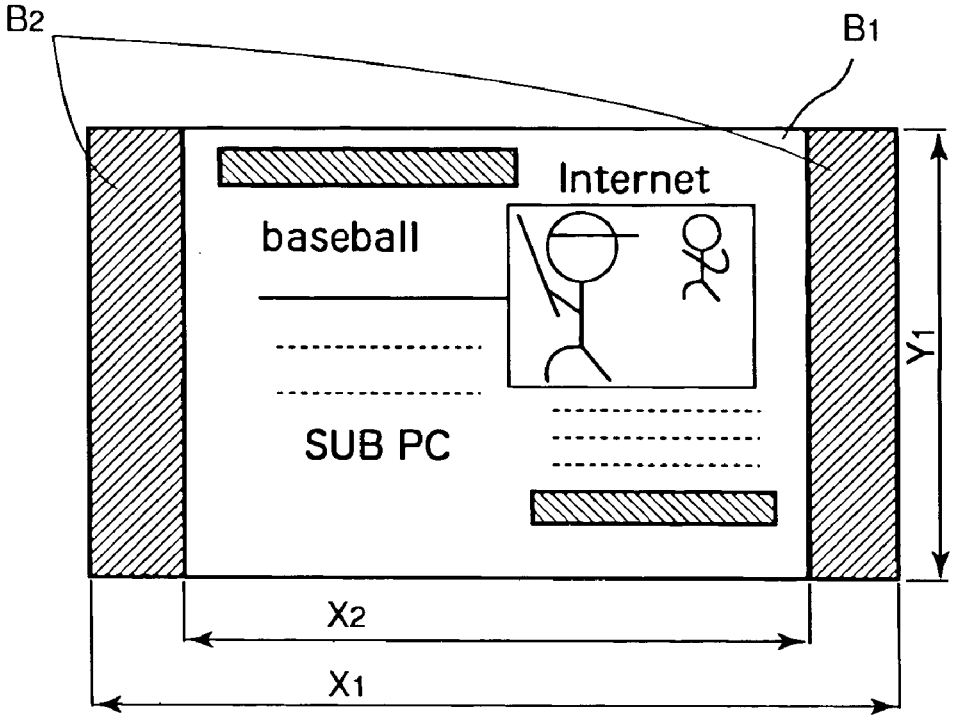
FIG. 1 A (PRIOR ART)
FIGS. 1A and 1B show relations between aspect ratios of images and aspect ratios of screens.
Figure 1B:
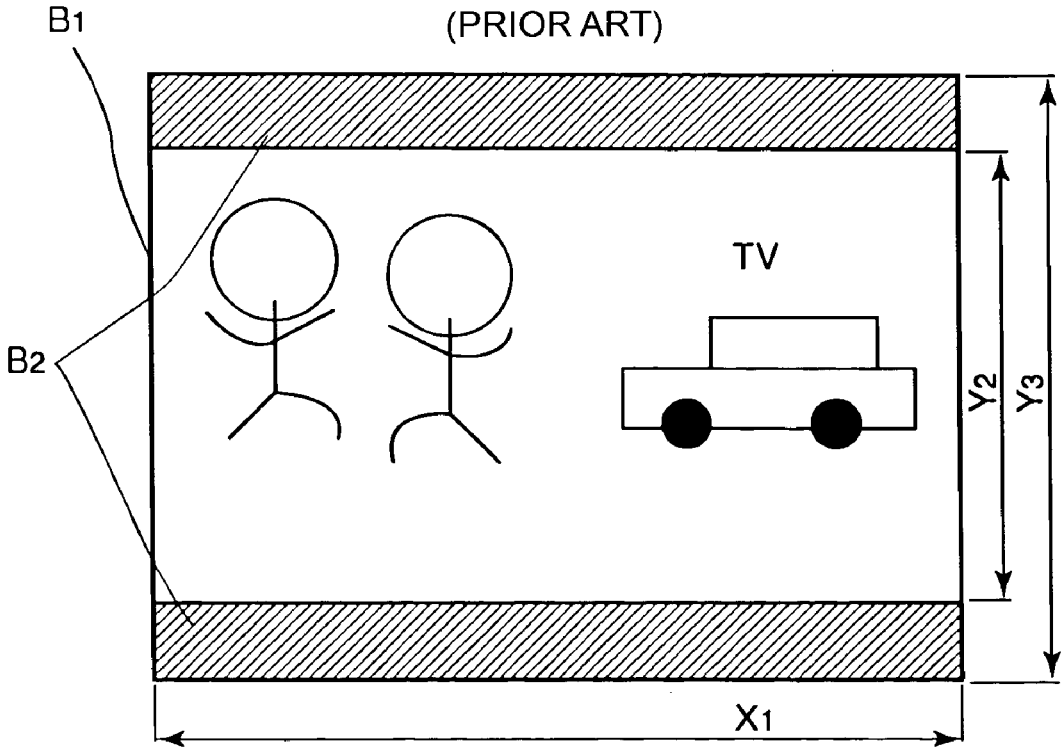
FIG. 1 B (PRIOR ART)

Here, the situation where the area of a screen is divided into the effective image area $B_1$ and the non-effective image area $B_2$ occurs, for instance, if the aspect ratio of an image to be displayed differs from the aspect ratio of the screen, as shown in FIGS. 1A and 1B.

Also, it does not matter whether a screen area includes only one effective image area $B_1$ (portion in which image display is performed) or a plurality of effective image areas $B_1$.

It should be noted here that gradation images may be displayed with a construction where a PWM-modulated signal is sent from the image signal generating unit 8 to the image display element 2. On receiving the PWM-modulated signal, the image display element 2 is driven according to a time divisional drive sequence to display a gray scale image. In this case, the image signal generating unit 8 converts a multi-level gradation image signal into a PWM-modulated signal.

Here, full-color display based on a so-called field sequential scheme (color sequential switching scheme) may be performed using the image display apparatus 1. That is, the lighting device 3 sequentially emits light in each color toward the image display element 2, the image display element 2 changes images in synchronization with the emission of light, the changed images are recognized as images in respective colors, and the color images are mixed so as to be recognized as a full-color image. In this case, in the non-effective image area $B_2$, dark display is continuously performed and bright display is performed for a very short time period during the dark display. It is preferable that this bright display is performed in display periods assigned to a specific color, such as blue. Also, a construction is preferred where the display gradation level and display color during bright display are adjustable.

The following description concerns a method of driving the image display apparatus of the present embodiment mode.

In this embodiment mode, if images are displayed in part of a screen area and therefore the screen area is divided into the effective image area $B_1$ where image display is performed and the non-effective image area $B_2$ where image display is not performed, image display is performed as follows. The non-effective image area $B_2$ is placed in one of binary display states to continuously perform black display (OFF state) while image display is being performed in the effective image area $B_1$. During (in the middle of) the OFF display state, however, the non-effective image area $B_2$ is placed in the opposite display state (white display (ON state)) for a very short time period.

Here, the sentence "the non-effective image area $B_2$ is placed in the opposite display state (white display (ON state)) for a very short time period" in the above description means that the proportion of the period of the ON display state, out of binary display states, is increased to exceed 0%.

Generally, the life span of an image display element is estimated using results of accelerated reliability testing carried out under several predetermined conditions. One of these conditions is the ratio (duty ratio) between the period of one of the binary display states and the period of the other of the binary display states. For instance, the duty ratio is expressed as ON/OFF ratio=95/5. Generally, the reliability of an image display element is lowered in accordance with the increase in the difference (expressed by the duty ratio) in length between the ON period and the OFF period.

With the present invention, a situation is avoided where the duty ratio becomes 100/0 or 0/100 in the non-effective image area.

In more detail, the time difference between the ON period and the OFF period is lowered during driving by, for instance, giving gradation or applying color to a level that does not annoy users. It is impossible to indicate the general level that does not annoy users, although it is found from simulation results that it is preferable that the proportion of the display period of the opposite display state, in which the image display element is placed for a very short time period, is set to exceed 0% but not to exceed 20%.

In usual cases, full-color images are displayed not by faithfully reproducing color tones but by emphasizing blue tone (not green tone and red tone) to a degree. In this manner, images with tinges of blue are displayed. This may be because fluorescent lamps with high color temperatures are generally used in Japan and therefore full-color images are set to correspond to the high color temperatures. Accordingly, in the case where full-color images are displayed, if dark display is continuously performed and blue display (bright display) is performed for a very short time period during the dark display in the non-effective image area $B_2$, both of the effective image area $B_1$ and the non-effective image area $B_2$ take on blue tinges and therefore users do not have a feeling of wrongness. Note that in countries (such as in the West) where users prefer television images or the like that take on red tinges and have low color temperatures, the setting should be changed so that red display (bright display) is performed for a very short time period during continuous dark display in the non-effective image area $B_2$.

It should be noted here that it is not required to perform the reversal of display states in the non-effective image area $B_2$ throughout the period during which image display is performed in the effective image area $B_1$. For instance, while images in the effective image area $B_1$ are changed each time a unit period (field period) has passed, the reversal of display states may be cyclically performed for a very short time period in the non-effective image area $B_2$ each time several field periods have passed. This point is described in more detail below.

Figure 6:
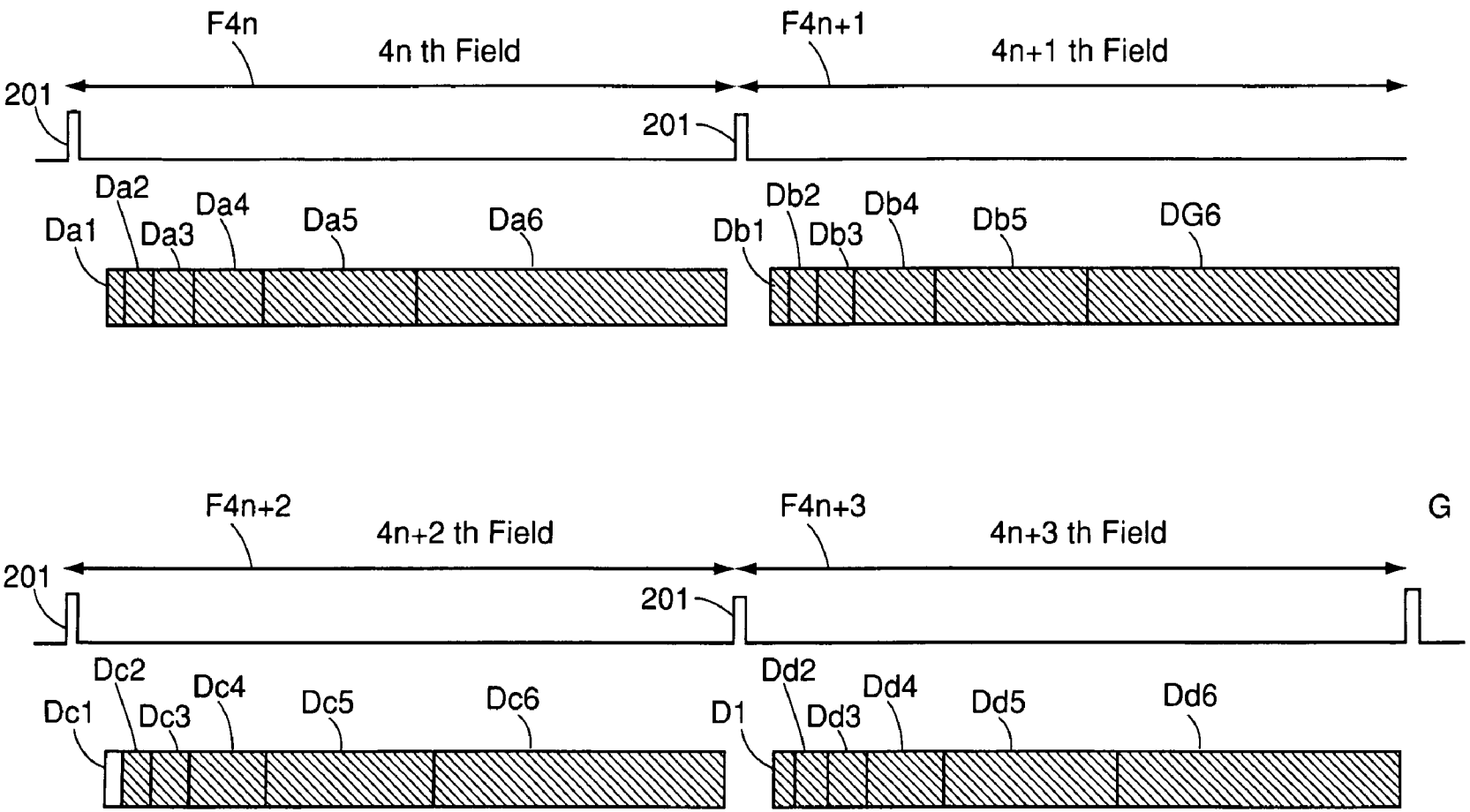
FIG. 6 shows a pulse-width-modulated signal inputted into the image display element.
Figure 7A:
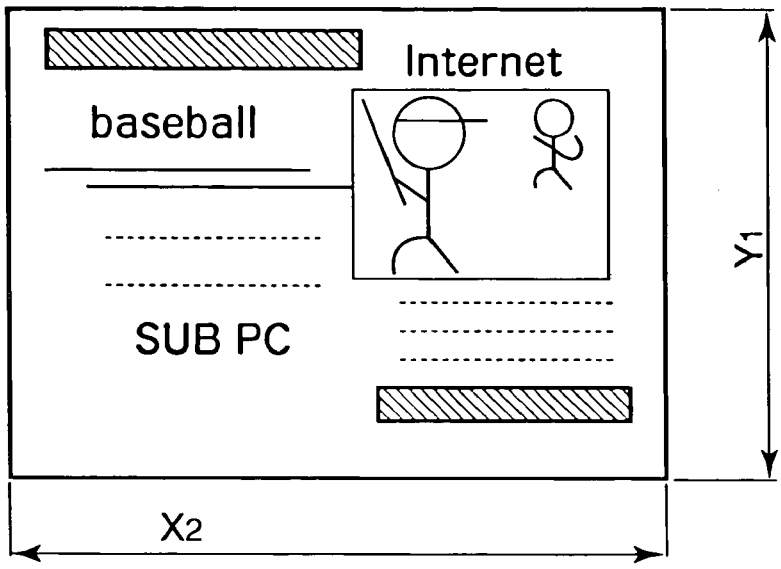
FIG.7A (PRIOR ART)
FIGS. 7A and 7B show example aspect ratios of various images.
Figure 7B:
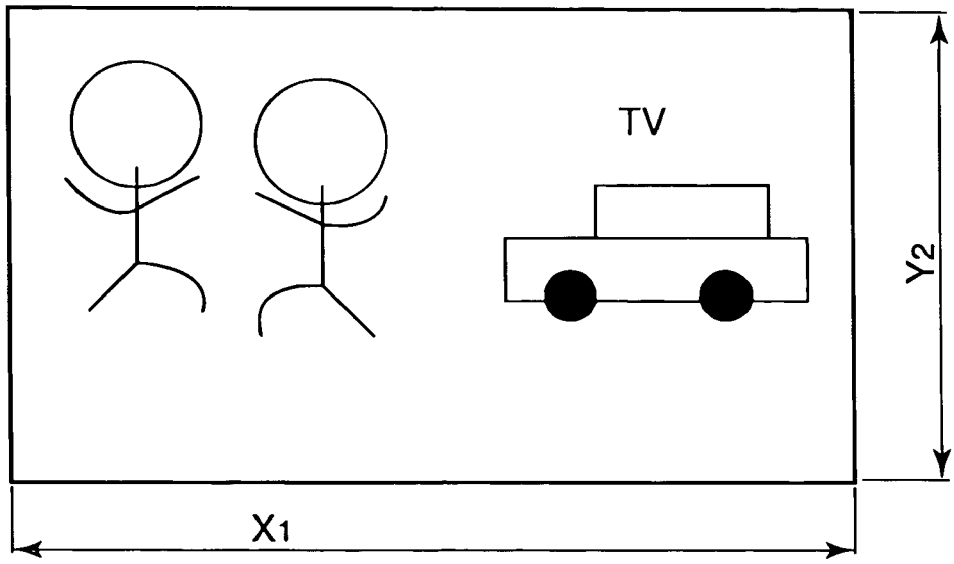
FIG.7B (PRIOR ART)
Figure 8:
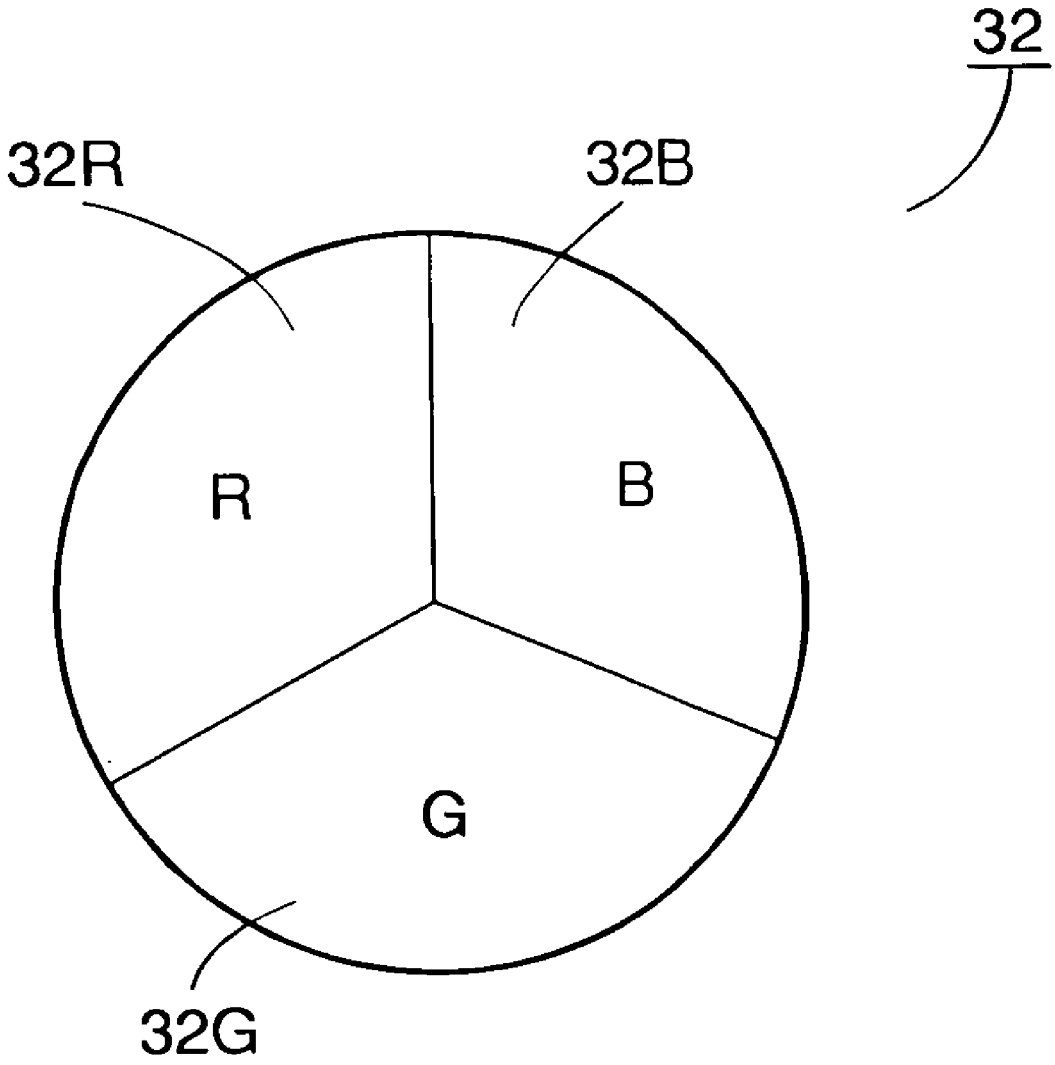
FIG.8 (PRIOR ART)
FIG. 8 shows the shape and the like of a color filter.
Figure 9:
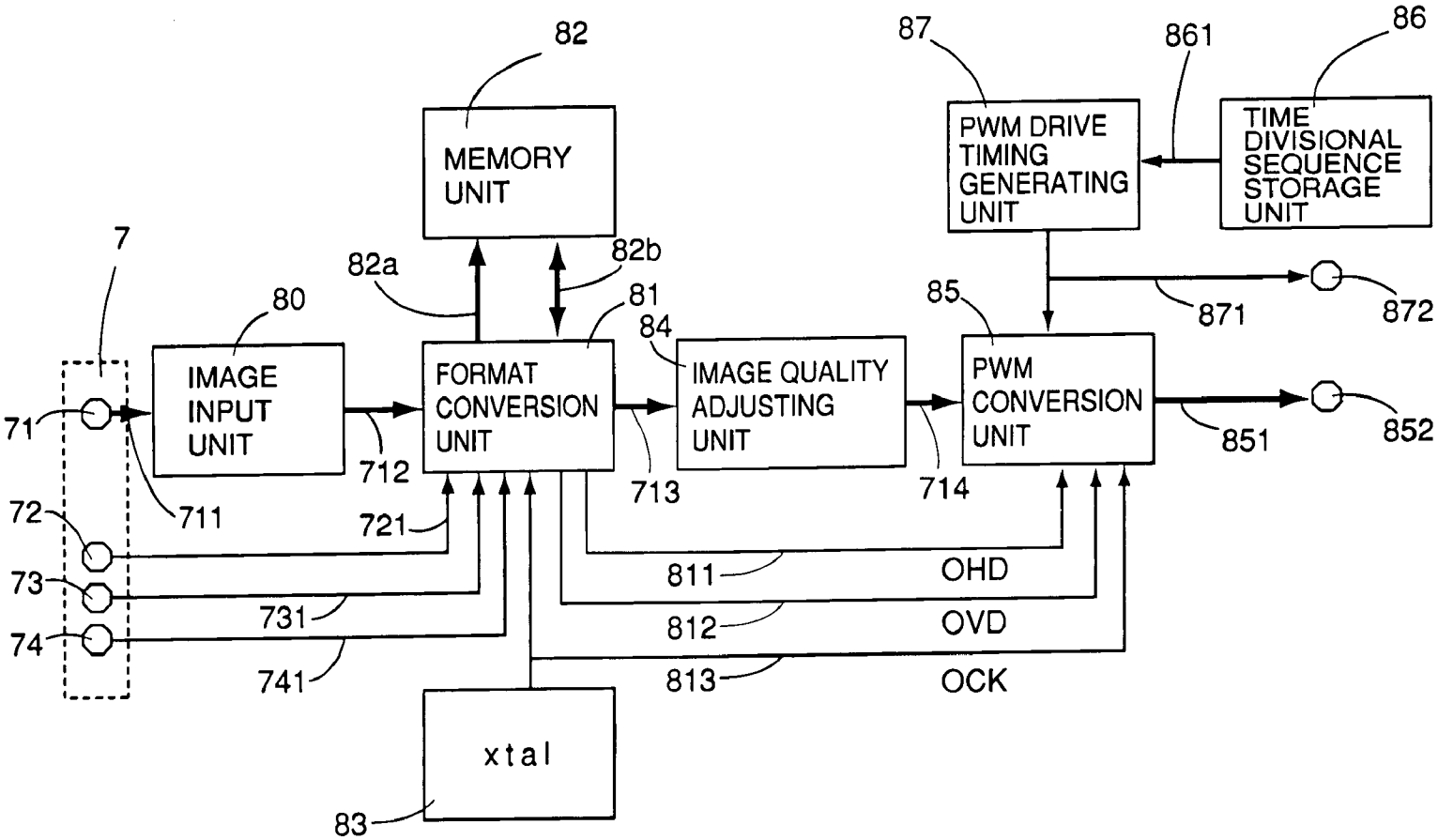
FIG. 9 (PRIOR ART)
FIG. 9 is a block diagram showing the detailed construction and the like of still a signal processing unit.

As indicated by reference symbol Dc1 in FIG. 6, the reversal of display states is performed for a very short time period in a specific field period $F_{4n+2}$ each time four field periods have passed.

Figure 4:
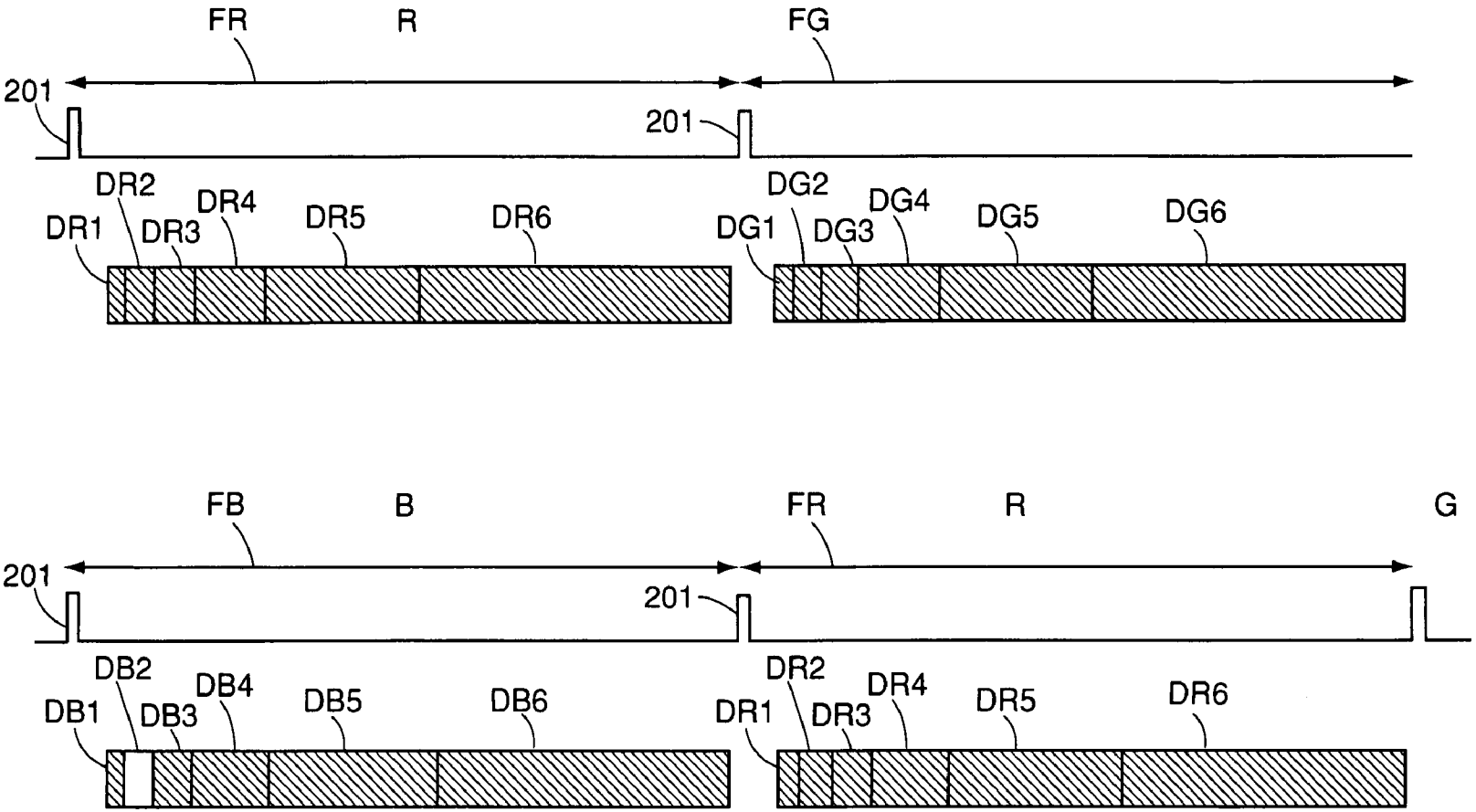
FIG. 4 shows a pulse-width-modulated signal inputted into an image display element.

As indicated by reference symbol DB2 in FIG. 4, in the case where color image display is performed with a field sequential scheme described above, the reversal of display states is performed for a very short time period in a display period FB assigned to a specific color.

In these cases, the reversal of display states for a very short time period is performed so as to correspond to each signal related to a low gradation (as indicated by the reference symbol Dc1 in FIG. 6 and the reference symbol DB2 in FIG. 4). By doing so, the degrees of brightness change and color change caused by the reversal of dark display into non-dark display in the non-effective image area $B_2$ are suppressed to a visual recognition level where users are not annoyed. As a result, the degradation of the element is prevented and the life span of the element is increased without degrading image quality.

If the reversal of display states is performed for a very short time period in specific field periods with imparting a brightness change under a condition where the screen refresh frequency is low, this results in flicker phenomenon where brightness changes on the screen are recognized by a viewer. Recently, however, there are many cases where the screen refresh frequency is set at high frequency, such as 120–480 Hz, to suppress color cracking phenomenon (color break down phenomenon) that is a problem unique to the color sequential switching scheme. Therefore, by setting the cycle for giving a display element protection signal at 50 Hz or higher where flicker is rarely recognized, the protection of a spatial modulation element can be effectively performed without annoying users. Also, even below 50 Hz, the protection of a spatial modulation element can be performed without annoying users by reducing the degree of brightness changes or adding white noise.

Consequently, it is preferred that the aforementioned reversal of display states for a very short time period in the non-effective image area $B_2$ is cyclically performed at a frequency lower than the screen refresh frequency of the image display element 2. It is also preferred that the reversal of display states for a very short time period is cyclically performed at a frequency of 50 Hz or higher.

As described above, it is preferred that the proportion of the total effective time of bright display to the entire display period is set to exceed 0% but not to exceed 20%. Also, it is preferred that the bright display is cyclically performed. For instance, the bright display is cyclically performed each time several field periods have passed. Also, it is preferred that the bright display is cyclically performed at a frequency lower than the screen refresh frequency of the image display element. Further, it is preferred that the bright display is cyclically performed at a frequency of 50 Hz or higher.

Here, it is preferable that the screen refresh frequency is 50 Hz or higher. As described above, it is preferable that the proportion of the total effective time of bright display to the entire display period is set not to exceed 20%. Therefore, if bright display is performed once in a non-effective image area each time a screen is refreshed, it is preferable that the effective time of one bright display operation is set at $\frac{1}{50}\times\frac{1}{5}=4$ ms or less. In this case, the condition that the effective time of one bright display operation should be kept at 4 ms or less is also satisfied.

The following description concerns the effects of the present embodiment mode.

In the present embodiment mode, dark display is continuously performed and this display state is reversed into bright display for a very short time period in the non-effective image area $B_2$. This suppresses the degradation of the image display element 2, improves the reliability and life span of a product, and prevents the degradation of image quality. In more detail, in the case of an MEMS element, the degradation of micromechanical characteristics, such as hinge storage, is prevented (this effect is to be described in more detail later). In particular, non-dark display is repeatedly performed for a very short time period, so that a sufficient effect of suppressing the degradation is achieved, with viewers rarely feeling visual interferences.

Also, Japanese Patent Application Laid-open No. 05-232897 describes a technique of achieving a display apparatus that is easy to view from ergonomic viewpoint by providing peripheral pixels in addition to pixels in an original display area and by adding means for giving a data signal to the peripheral pixels to apply color to peripheral regions of the original display area. However, the object of the present invention is to prevent the reduction of reliability caused when only one of the binary display states continues for a long time. Therefore, as aforementioned, the present invention is applicable to the case where a tri-plate display apparatus performs blue display. As is apparent from this, the object of the present invention is not to apply color or give a gradation to the non-effective image area but to avoid a situation where only one of binary display states continues for a long time. As a result, the prevent invention differs from the stated patent application in the object and content.

It should be noted here that if the present invention is applied to an MEMS element, the degradation of micromechanical characteristics, such as hinge storage, is prevented, as described above. This effect is described in more detail below.

Figure 18:
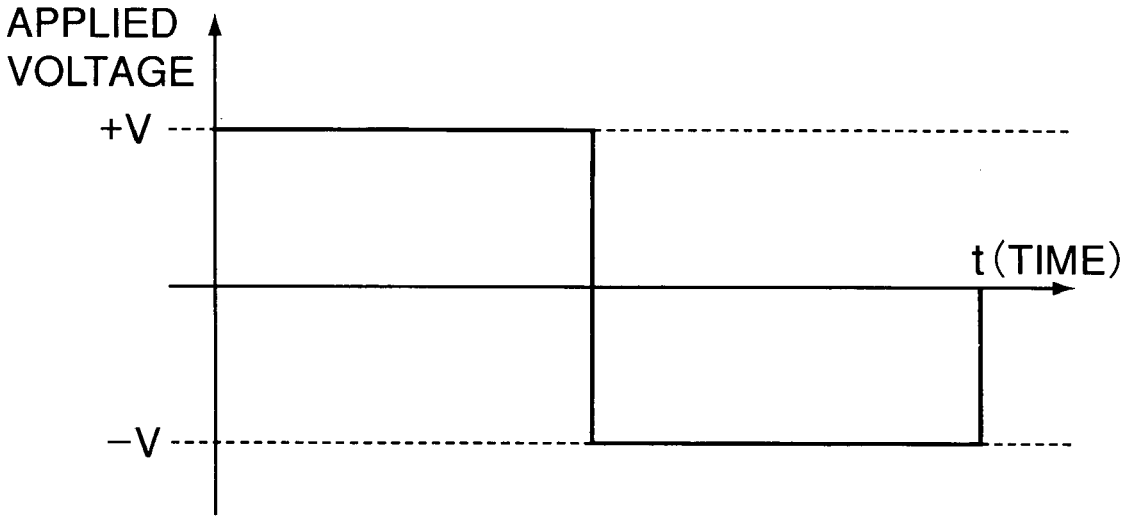
FIG. 18 shows the waveform of a voltage applied to a liquid crystal.

To drive a liquid crystal panel, the polarity of an applied voltage is reversed at certain intervals in general cases (see FIG. 18). This operation is performed to prevent liquid crystal burn-in caused by the bias of an ion distribution within a liquid crystal cell between two electrodes.

Figure 19:
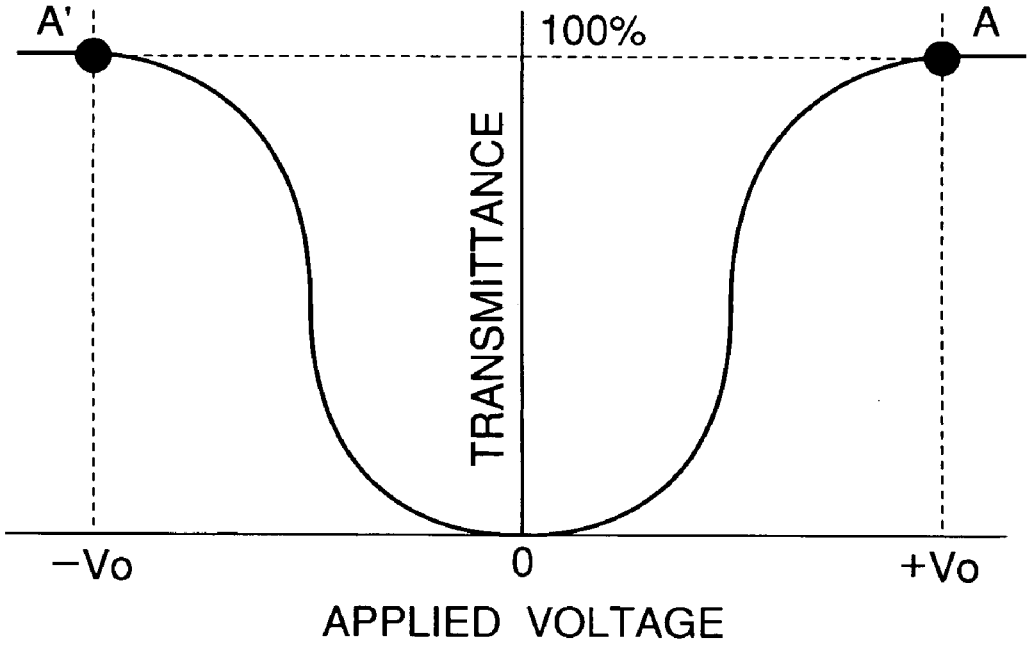
FIG. 19 shows a characteristic curve showing the relation between the applied voltage and transmittance.

In the case of a general liquid crystal (a so-called V-shaped liquid crystal), the characteristic curve showing the relation between an applied voltage and transmittance is symmetrical, as shown in FIG. 19. Therefore, if the absolute value of the applied voltage is not changed after the polarity reversal, the transmittance remains constant and display is not affected.

Figure 20:
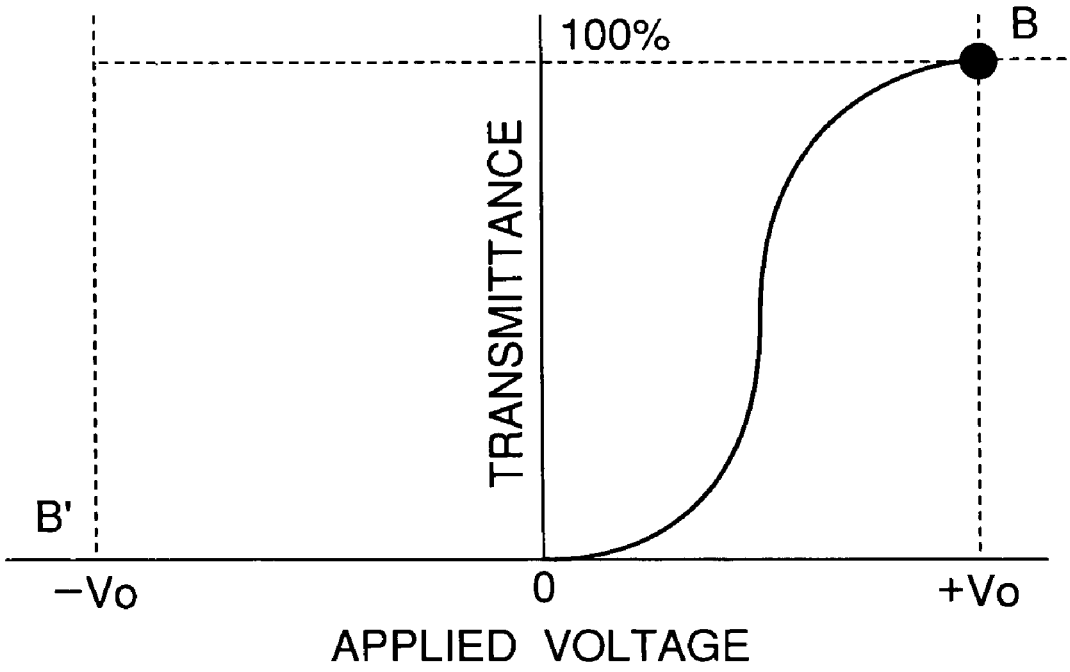
FIG. 20 shows another characteristic curve showing the relation between the applied voltage and transmittance.
Figure 21:
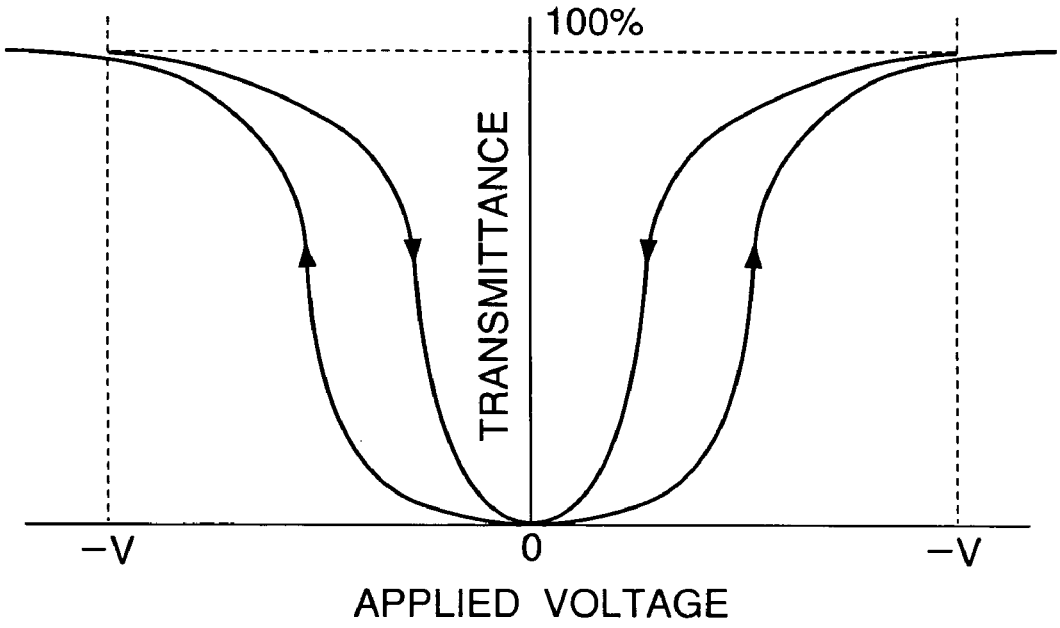
FIG. 21 shows still another characteristic curve showing the relation between the applied voltage and transmittance.

On the other hand, in the case of a liquid crystal (a so-called one-side V-shaped liquid crystal) having a characteristic curve shown in FIG. 20, the polarization reversal causes the change in transmittance and the transmittance becomes zero in the case of a negative polarity. However, by driving each pixel of a screen in the same manner, the display gradation is not affected (although the brightness of the entire screen is halved).

Figure 22:
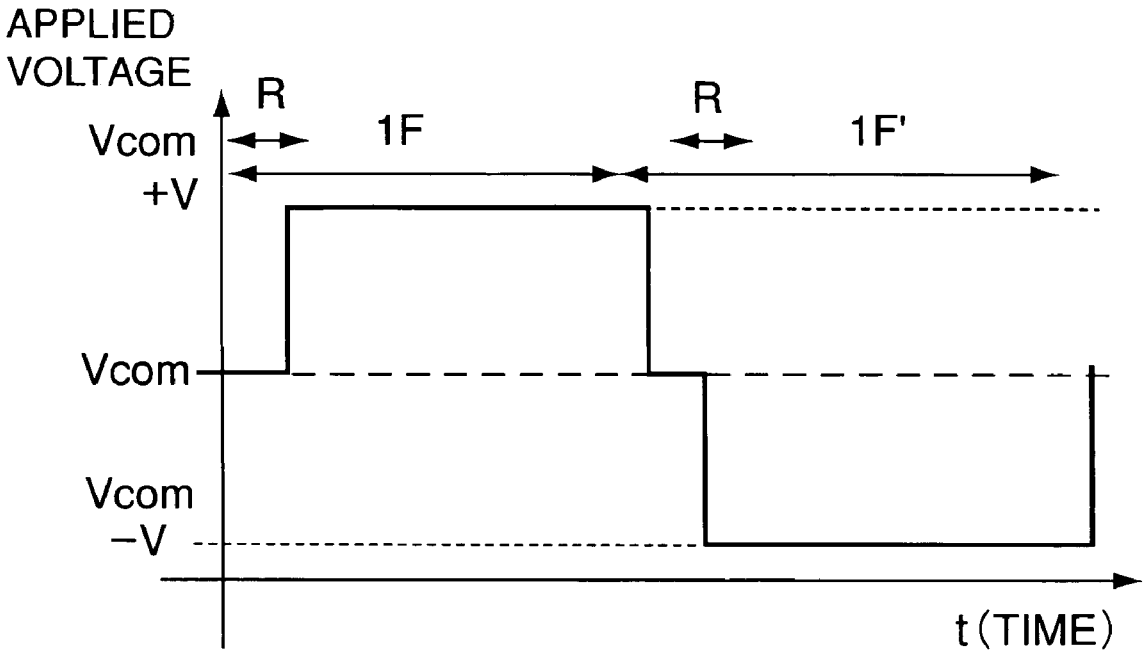
FIG. 22 shows the waveform of a voltage applied to a liquid crystal.

The characteristic curves in FIGS. 19 and 20 constantly and gradually changes, so that halftones can be displayed by controlling a voltage. However, in the case of a liquid crystal of a binary display type, such as a ferroelectric liquid crystal or an antiferroelectric liquid crystal, the characteristic curve has a shape shown in FIG. 22 and may exhibit a hysteresis property. In the case where the voltage-transmittance characteristic has a hysteresis property, even if the same black state is displayed, the transmittance varies depending as to which of a white state or a black state is formerly displayed. Therefore, the former image persists like an afterimage and influences the current image. Japanese Patent Application Laid-open Nos. 6-167952 and 6-202078 describe a method of preventing the afterimage phenomenon due to the hysteresis by temporarily resetting the entire screen to one of the binary display states. However, this driving method concerns the prevention of the hysteresis problem and therefore does not prevent image burn-in. To prevent image burn-in, it is also required to reverse the polarity of a reset voltage at certain intervals during the application of the reset voltage. FIG. 22 shows an example where a voltage is applied to a signal electrode of a liquid crystal display element in this manner. A central voltage Vcom is a potential of an electrode that opposes a signal electrode, where a liquid crystal layer is sandwiched between these electrodes. Vsig is a voltage applied to the signal electrode. A 1F period represents a period during which one image is displayed and the applied voltage is reversed in the next 1F' period. Display with the same transmittance is performed in both the first 1F period and the next 1F' period. FIG. 22 concerns the case where display with transmittance of 100% is performed. Also, an R period between the 1F period and the 1F' period is a reset period and Vsig=Vcom voltage is applied to the signal electrode. Consequently, the potential difference between the electrodes becomes zero and the transmittance also becomes zero in the R period. Like the case shown in FIG. 18, a voltage that is symmetric with respect to Vcom is applied to the signal electrode in the 1F period and the 1F' period.

In a liquid crystal, the polarity of an applied voltage is reversed to prevent image burn-in, although it is required to nearly equalize the time period for applying a positive polarity voltage with the time period for applying a negative polarity voltage. However, in the case where the present invention is applied to an MEMS element, it is not required to equalize the time period for performing dark display with the time period for performing bright display. If anything, it is required to reduce the bright display time period to 20% or less in order to prevent a situation where viewers visually recognize the bright display. In this respect, the present invention greatly differs from the case of a liquid crystal.

EMBODIMENTS

The present invention is described in more detail below according to embodiments.

First Embodiment

The present embodiment is described based on the projection-type image display apparatus 1 having the construction shown in FIG. 2. In this drawing, reference numeral 1001 indicates a main power source. When an ON/OFF button 1002 is pushed, the main power source 1001 starts supplying power to the signal processing unit 8 and the image display element 2. When the ON/OFF button 1002 is pushed again, a process for terminating the power supply from the main power source 1001 is started and, in usual cases, the power supply is terminated by this process. The non-dark display (image reversal) in a non-effective image area to be described later is mainly performed between (1) a time when a user turns on the ON/OFF button 1002 and the power supply to the display element is started and (2) a time when the user pushes the ON/OFF button 1002 again. Note that the overall construction of this display apparatus 1 has already been described and therefore is not explained again here.

Figure 3:
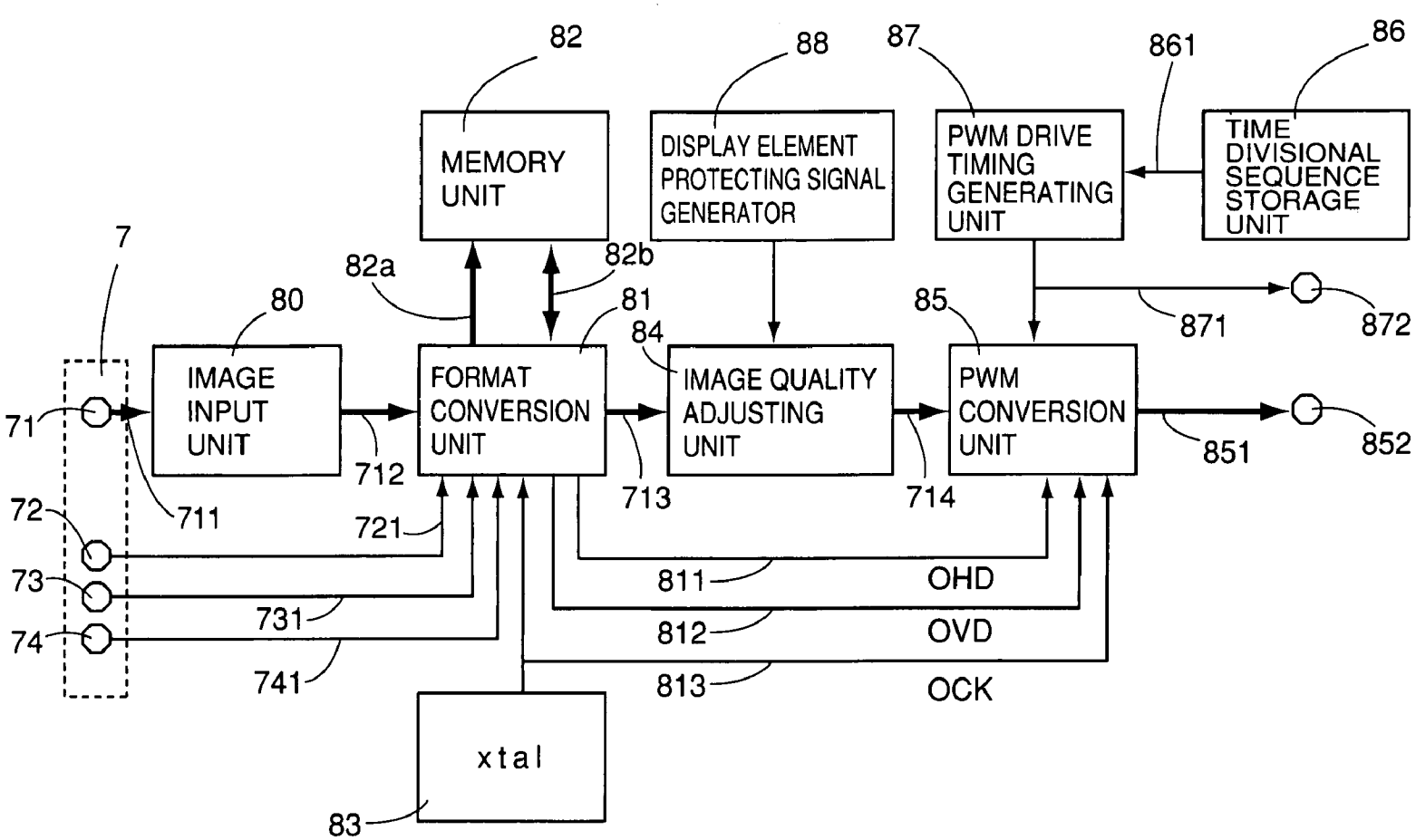
FIG. 3 is a block diagram showing the detailed construction and the like of a signal processing unit.

The signal processing unit 8 of this embodiment has a construction shown in FIG. 3. This drawing is a block diagram showing the detailed construction and the like of this signal processing unit 8 of the present invention.

An input unit 7 for inputting various input signals includes an input terminal 71 for inputting an image signal, an input terminal 72 for inputting a horizontal synchronizing signal (IHD) among the input signals, an input terminal 73 for inputting a vertical synchronizing signal (IVD) among the input signals, and an input terminal 74 for inputting a clock signal (ICLK) among the input signals.

In this drawing, reference numerals 711, 712, 713, and 714 represent data buses for transmitting the image signals. Reference numeral 721 indicates a signal line for transmitting the horizontal synchronizing signal (IHD) among the input signals, numeral 731 indicates a signal line for transmitting the vertical synchronizing signal (IVD) among the input signals, and numeral 741 indicates a signal line for transmitting the clock signal (ICLK) among the input signals.

Reference numeral 80 denotes an image input unit that is an image signal receiving unit. For instance, the image input unit 80 includes a decoder that receives a signal based on a TMDS scheme and decodes the received signal into 24-bit data (three pieces of 8-bit data that respectively correspond to RGB). Here, the TMDS scheme is an image transmission scheme adopted by, for instance, the DVI (Digital Visual Interface) specification published by the standardizing group "DDWG (Digital Display Working Group)". Alternatively, the image input unit 80 includes a decoder that receives a compression signal in an MPEG format via IEEE 1394 and decodes the received compression signal into 24-bit data (three pieces of 8-bit data that respectively correspond to RGB).

Reference numeral 81 represents a format conversion unit that performs resolution conversion, image refresh frequency conversion, non-interlace processing, color matrix conversion, and the like. Here, the resolution conversion includes magnification conversion and interpolation processing that are appropriately performed for an image signal whose resolution does not match the number of display pixels of the image display unit. In this embodiment, the format conversion unit further converts the coordinate area in an image and adds a signal for displaying a black frame, so that dark display is performed in the non-effective image area.

Also, reference numeral 82 represents a memory unit that provides an image storage area used by the format conversion unit to perform image processing. Reference numeral 82*a* indicates a control line group of the memory unit and numeral 82*b* indicates a data line group for transferring data between the memory unit and the format conversion unit. Reference numeral 83 denotes a crystal oscillator. According to the clock signal (OCLK) generated by the crystal oscillator 83, the format conversion unit 81 generates a horizontal synchronizing signal (OHD) and a vertical synchronizing signal (OVD), which are used to establish synchronization after the format conversion processing, under the control by a microcomputer unit (not shown). Reference numeral 811 indicates a signal line for transmitting the horizontal synchronizing signal (OHD), numeral 812 indicates a signal line for transmitting the vertical synchronizing signal (OVD), and numeral 813 indicates a signal line for transmitting the clock signal (OCLK) generated by the crystal oscillator.

Reference numeral 84 represents an image quality adjusting unit that receives the image signal subjected to the format conversion and adjusts image quality, such as brightness, color characteristics, and gamma characteristics, of images to be displayed on the display unit, according to the control by the microcomputer unit (not shown).

As shown in FIG. 3, a display element protecting signal generator 88 is connected to the image quality adjusting unit 84. The display element protecting signal generator 88 generates a signal for placing pixels in the aforementioned non-effective image area $B_2$ (in which dark display is performed by the processing of the format conversion unit 81) of the image display element 2 in an ON state for a very short time period without allowing the user to recognize the ON state. As described above, if images having blue tinges are displayed by television sets or the like, users feel that the image quality is superior. Therefore, in this embodiment, the pixels are placed on the ON state only during a period corresponding to the second bit from the least significant bit in each blue sub-field period (see reference symbol DB2 in FIG. 4). In this manner, aside from the black frame display signal added by the format conversion unit 81 to the non-effective image area, the display element protecting signal generator 88 generates a display element protecting signal for placing pixels in the non-effective image area in the ON state only during a period corresponding to the second bit of a blue signal from the least significant bit. Then, the image quality adjusting unit 84 combines the display element protecting signal with the black frame display signal.

Reference numeral 85 indicates a PWM conversion unit for converting an ordinary image signal for sequential scanning into a time divisional display signal by performing the pulse width modulation (PWM), numeral 86 indicates a time divisional sequence storage unit for storing time divisional drive sequence data describing the display order and display time period of the PWM-modulated data, numeral 87 indicates a PWM drive timing generating unit for generating, according to the time divisional drive sequence, driving timing used by the PWM conversion unit 85 and the spatial modulation element that is an image display unit. Reference numeral 861 denotes a transmission line for transmitting the drive sequence data from the time divisional sequence storage unit 86 to the PWM drive timing generating unit 87, and numeral 871 indicates a control line group for transmitting a driving pulse generated by the PWM drive timing generating unit 87 and other signals. Also, reference numeral 872 represents an output terminal via which control signals, such as the driving pulse, are outputted to the image display element 2, numeral 851 indicates a data bus for transmitting the image data converted by the PWM conversion unit 85, and numeral 852 indicates an output terminal via which the image data is outputted to the image display element 2.

The PWM drive timing generating unit 87 generates the control signal for the PWM conversion unit 85 and the driving pulse for the display element according to the sequence data in the time divisional sequence storage unit 86. That is, the image inputted into the signal processing unit 8 is subjected to appropriate format conversion and image quality adjustment and then converted into the time divisional drive signal by the PWM conversion unit 85. The PWM conversion unit 85 and the display element are driven in synchronization with each other.

FIG. 4 shows an example of the display data sequence that has been PWM-modulated by the PWM conversion unit 85. The display data sequence in this drawing corresponds to the non-effective image area $B_2$. In this drawing, the horizontal axis represents time and reference numeral 201 denotes a start pulse designating the start of image display in each color of RGB within one field. Reference symbol FR indicates a sub-field period during which red display is performed, reference symbol FG indicates a sub-field period during which green display is performed, and reference symbol FB indicates a sub-field period during which blue display is performed.

Figure 10:
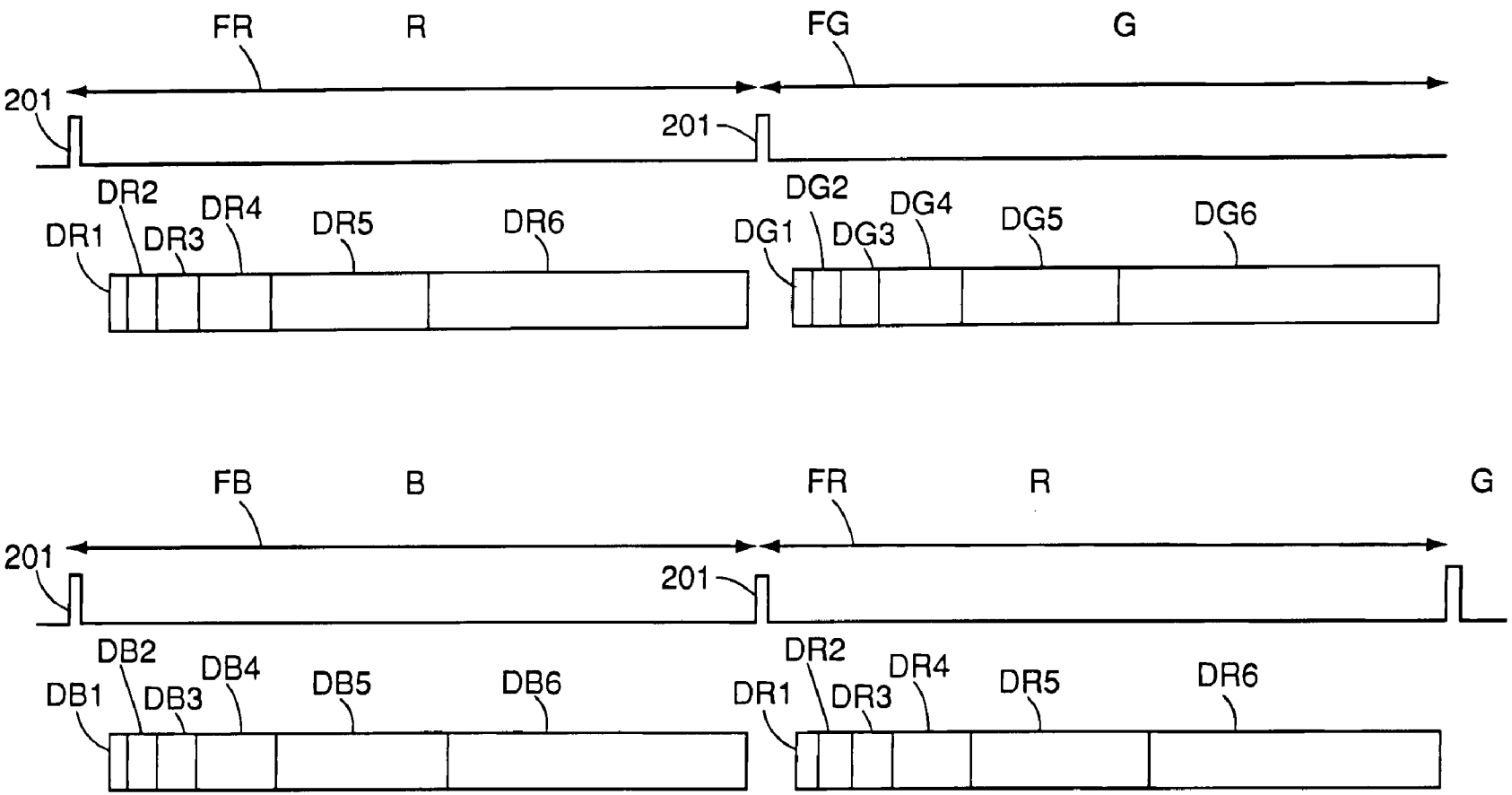
FIG. 10 (PRIOR ART)
FIG. 10 shows a pulse-width-modulated signal inputted into the image display element.

Also, as described by referring to FIG. 10, reference symbols DR1–DR6 represent display data in red that has been PWM-modulated, reference symbols DG1–DG6 represent display data in green that has been PWM-modulated, and reference symbols DB1–DB6 represent display data in blue that has been PWM-modulated. In either case of these display data, the pulse length of each bit signal is twice as long as that of the next lower bit signal.

In this embodiment, ON display is performed only for a second-bit signal DB2 in the blue display sub-field period FB and OFF display is performed for all of other signals (that is, DR1–DR6, DG1–DG6, and DB1–DB6 except for DB2). By doing so, completely black display is not performed but black image to which blue is slightly added (shade 2 out of 64 shades of gray scale=around 3%) is displayed in the non-effective image area $B_2$. In this manner, the image display element is placed in an ON state for a time period accounting for 1% of the entire time period including three sub-field periods FR, FG, and FB. As described above, this suppresses the degradation of the image display element 2, improves the reliability and life span of a product, and prevents the degradation of image quality. In more detail, in the case of an MEMS element, the degradation of micromechanical characteristics, such as hinge storage, is prevented.

Because one field (one screen refresh period) is set at 60 Hz, the effective time of one bright display operation in the non-effective image area $B_2$ becomes 1s/60×2/64×1/3=173 μs. If a retrace time is set, the effective time of one bright display operation becomes shorter. It is preferable that the screen refresh period is set at 50 Hz or higher to prevent flicker. Also, according to experimental results, it is found that the preferable brightness is 20% or less to prevent the brightness of the black mask from becoming an annoying level. This will be described in more detail later. In the present embodiment, bright display is performed for a very short time period in the sub-field for blue display. However, the bright display may be performed in sub-fields corresponding to all colors. Even if the bright display is performed in sub-fields for all colors, the brightness of the black mask is not increased to an annoying level because the effective time of one bright display operation is set at 173 μ

The present embodiment concerns a case where, in a projection-type image display apparatus adopting a color sequential switching scheme, ON display is performed for a bit having a short bit pulse in each sub-field corresponding to one of RGB. However, the present invention is not limited to the color sequential switching scheme and is also applicable to every display apparatus that displays images according to a time divisional drive scheme.

Second Embodiment

The present embodiment is described based on the protection-type image display apparatus 1 having the construction shown in FIG. 2. Note that the overall construction of this display apparatus 1 has already been described and therefore is not explained again here.

Figure 5:
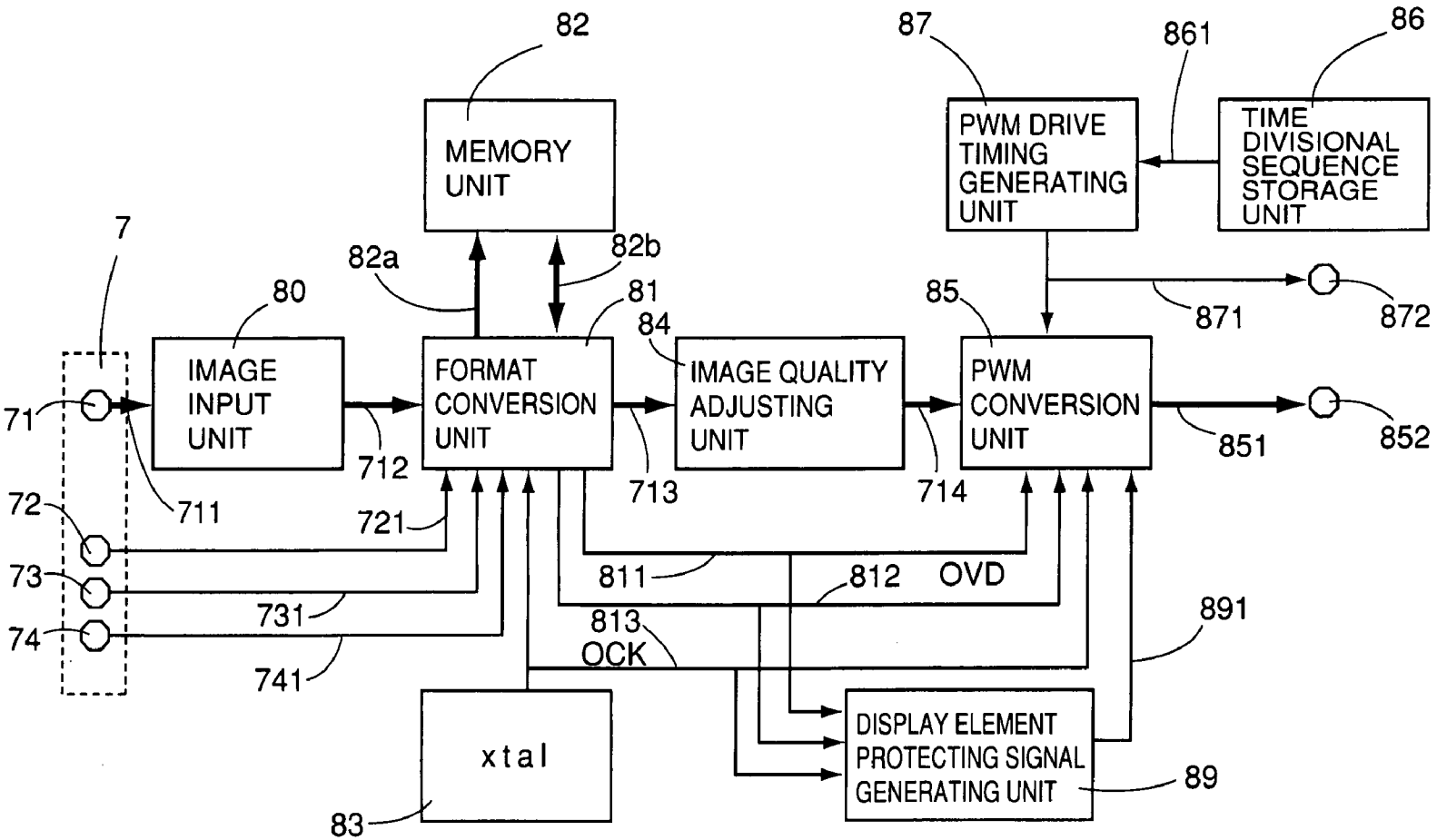
FIG. 5 is a block diagram showing the detailed construction and the like of a signal processing unit.

The signal processing unit 8 of the present embodiment has a construction shown in FIG. 5. Here, FIG. 5 is a block diagram showing the detailed construction and the like of the signal processing unit 8 of the present embodiment.

As distinct from the construction shown in FIG. 3, the present signal processing unit has a construction where the display element protecting signal generator is not connected to the image quality adjusting unit 84. Alternatively, as indicated by reference numeral 89, the display element protecting signal generating unit is connected between the format conversion unit 81 and the PWM modulation unit 85. Other constructions in this drawing are the same as those in FIG. 3, and therefore are assigned the same reference numerals and are not described here. The following description centers on differences between these drawings.

Like the display element protecting signal generator 89 of the first embodiment, if an image whose aspect ratio differs from that of a display screen is to be displayed, the display element protecting signal generating unit 89 generates a signal for placing pixels in a non-effective image area of the image display element in an ON state for a very short time period during a black display operation without allowing a user to recognize the ON state. In this embodiment, the display element protecting signal generator 89 is connected to three signal lines 811, 812, and 813, with a horizontal synchronizing signal (OHD) being inputted via the signal line 811, a vertical synchronizing signal (OVD) being inputted via the signal line 812, and a clock signal (OCLK) generated by the crystal oscillator being inputted via the signal line 813. By counting the number of image output fields outputted from the format conversion unit 81, the display element protecting signal generator 89 generates the display element protecting signal for performing ON display (reversal of binary display states) in the non-effective image area $B_2$ only for the LSB (least significant bit) period in one of the four fields. This display element protecting signal is transmitted to the PWM conversion unit 85 via the data line 891. Then the PWM conversion unit 85 combines the display element protecting signal with an image signal and subjects the combined signal to the PWM modulation, or combines a PWM-modulated display element protecting signal with a PWM-modulated image signal. In this manner, display data is generated and is sent to the display unit.

FIG. 6 shows an example of the display data sequence that has been PWM-modulated by the PWM conversion unit 85. The display data sequence in this drawing corresponds to the non-effective image area $B_2$. In this drawing, the horizontal axis represents time and reference numeral 201 denotes a start pulse designating the start of image display in each color of RGB within one field. Also, reference symbol $F_{4n}$ indicates a 4nth field period, reference symbol $F_{4n+1}$ indicates a (4n+1)th field period, reference symbol $F_{4n+2}$ indicates a (4n+2)th field period, and reference symbol $F_{4n+3}$ indicates a (4n+3)th field period.

Reference symbols Da1–Da6, Db1–Db6, Dc1–Dc6, Dd1–Dd6 represent PWM-modulated display data in RGB. In either case of these display data, the pulse length of each bit signal is twice as long as that of the next lower bit signal.

In the present embodiment, ON display is performed in one field out of the four fields, or, more precisely, in the first bit period in the (4n+2)th field period $F_{4n+2}$, according to the display element protecting signal (as indicated by reference symbol Dc1). Also, OFF display is performed for other signals (that is, all of the remaining bits in the (4n+2)th field period and all bits in other fields). By doing so, in the non-effective image area $B_2$, completely black frame is not displayed but a black frame having a slight brightness (shade 1 out of 64 shades of gray scale=around 1.5%) is displayed once in each set of four fields. In this manner, the image display element is placed in an ON state of the binary display states for a time period accounting for 0.4% of the entire time period including four successive field periods. As described above, this suppresses the degradation of the image display element 2, improves the reliability and life span of a product, and prevents the degradation of image quality. In more detail, in the case of an MEMS element, the degradation of micromechanical characteristics, such as hinge storage, is prevented.

If one field (one screen refresh period) is set at 60 Hz, the effective time of one bright display operation performed in the non-effective image area $B_2$ becomes 1s/60×1/64×1=291 μs.

Here, if brightness is changed in one field in each set of a plurality of fields under a situation where the screen refresh frequency is low, the changes in brightness of the screen is recognized by a viewer (flicker phenomenon occurs). Recently, however, there are many cases where the screen refresh frequency is set at high frequency, such as 120–480 Hz, to suppress a color cracking phenomenon (color break down phenomenon) that is a problem unique to the color sequential switching scheme. Therefore, by setting the cycle for giving the display element protection signal at 50 Hz or higher where flicker is rarely recognized, the protection of a spatial modulation element can be effectively performed without annoying users. Also, even below 50 Hz, the protection of a spatial modulation element can be performed without annoying users by reducing the degree of brightness changes or adding white noise.

The present invention is characterized in that if one of the binary display states continues for a long time in an image display element, the current display state is reversed into an opposite display state for a very short time period. Therefore, in addition to a non-effective image area generated when an image whose aspect ratio differs from that of a screen is displayed, the present invention is applicable to various other areas. For instance, the present invention may be applied to a case where a screen area of a display is divided into a plurality of sub-screen areas and there is at least one sub-screen area, in which no image is being displayed. The present invention also may be applied to a mask area, such as a margin area, generated between the sub-screen areas.

Also, if a personal computer continuously displays letters or icons in a window screen or a desk top screen, certain pixels of an image display element performing binary display is placed in one of an OFF state and an ON state for a long time. The situation where certain pixels of an image display element is placed in one of an OFF state and an ON state for a long time also arises if still image display is performed for a long time. In these cases, a display apparatus is provided with an image attribute detecting unit that detects the situation where one of an OFF state and an ON state continues for a long time, and operations described in the first and second embodiments are applied to corresponding pixels according to the detection results of the image attribute detecting unit. This realizes an image display apparatus with a high degree of reliability.

The present embodiment has been described based on the projection-type image display apparatus 1 having the construction shown in FIG. 2. However, the present invention is not limited to this and is applicable to various image display apparatuses, such as tri-plate protection-type image display apparatus that uses one spatial modulation element for each color of RGB, as long as the image display apparatuses are driven according to time divisional drive sequences.

Third Embodiment

In the first and second embodiments, the present invention is applied to a display apparatus that displays an image signal whose aspect ratio differs from that of a display screen. In the present embodiment, however, the present invention is applied to an image display apparatus that is capable of displaying a plurality of sub-screen areas on a screen.

Figure 11:
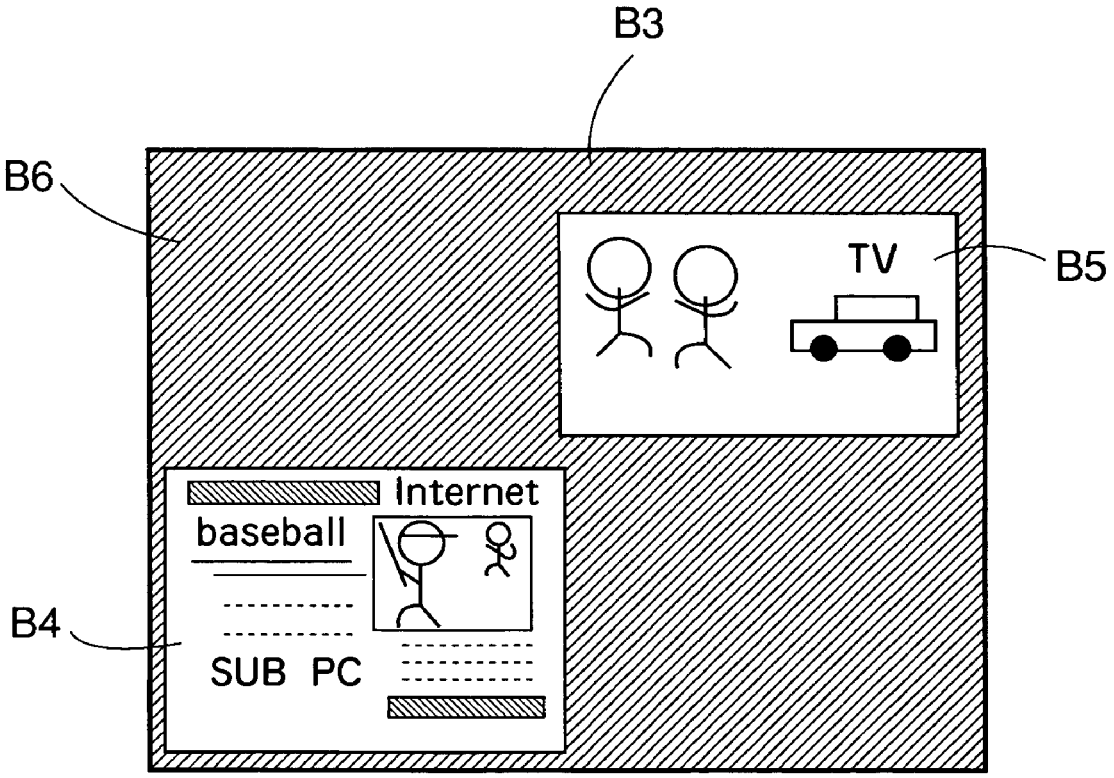
FIG. 11 shows an example screen state of an image display apparatus that is capable of simultaneously generating a plurality of sub-screen areas.

FIG. 11 shows an example state of a screen of the image display apparatus of the present embodiment.

Reference symbol B3 in this drawing represents a display screen of the image display apparatus of the present embodiment. In this embodiment, the size of the screen is set as 2048 pixels wide by 1536 pixels high. Sub-screen areas B4 and B5 are arbitrary set in the screen area B3 of this image display apparatus. This construction achieves the simultaneous display of a plurality of image signals inputted into the image display apparatus.

Reference symbol B4 indicates a first sub-screen display area in which is displayed an image obtained by a personal computer (hereinafter, "PC") connected to the image display apparatus. The image obtained by the PC has a resolution of XGA (1024 pixels wide by 768 pixels high). Also, reference symbol B5 denotes a second sub-screen display area in which is displayed an image having a resolution of 720 pixels wide by 480 pixels high (suitable resolution for the second subscreen display area). This image displayed in the second sub-screen display area is generated by converting an HDTV image (1920 pixels wide by 1080 pixels high) that has been obtained by a digital television tuner connected to the image display apparatus.

Further, reference symbol B6 represents a non-effective image area in which image display is not performed. In this embodiment, a user can arbitrary set a gradation level for data in each color (red, green, and blue) to be displayed in the non-effective image area of the present image display apparatus. The user performs this setting operation using a user setting means including switches provided on the display apparatus and buttons of a remote controller. As a result, in addition to a general black mask, a halftone mask and masks colored in various colors (such as blue and yellow) can also be displayed.

Figure 12:
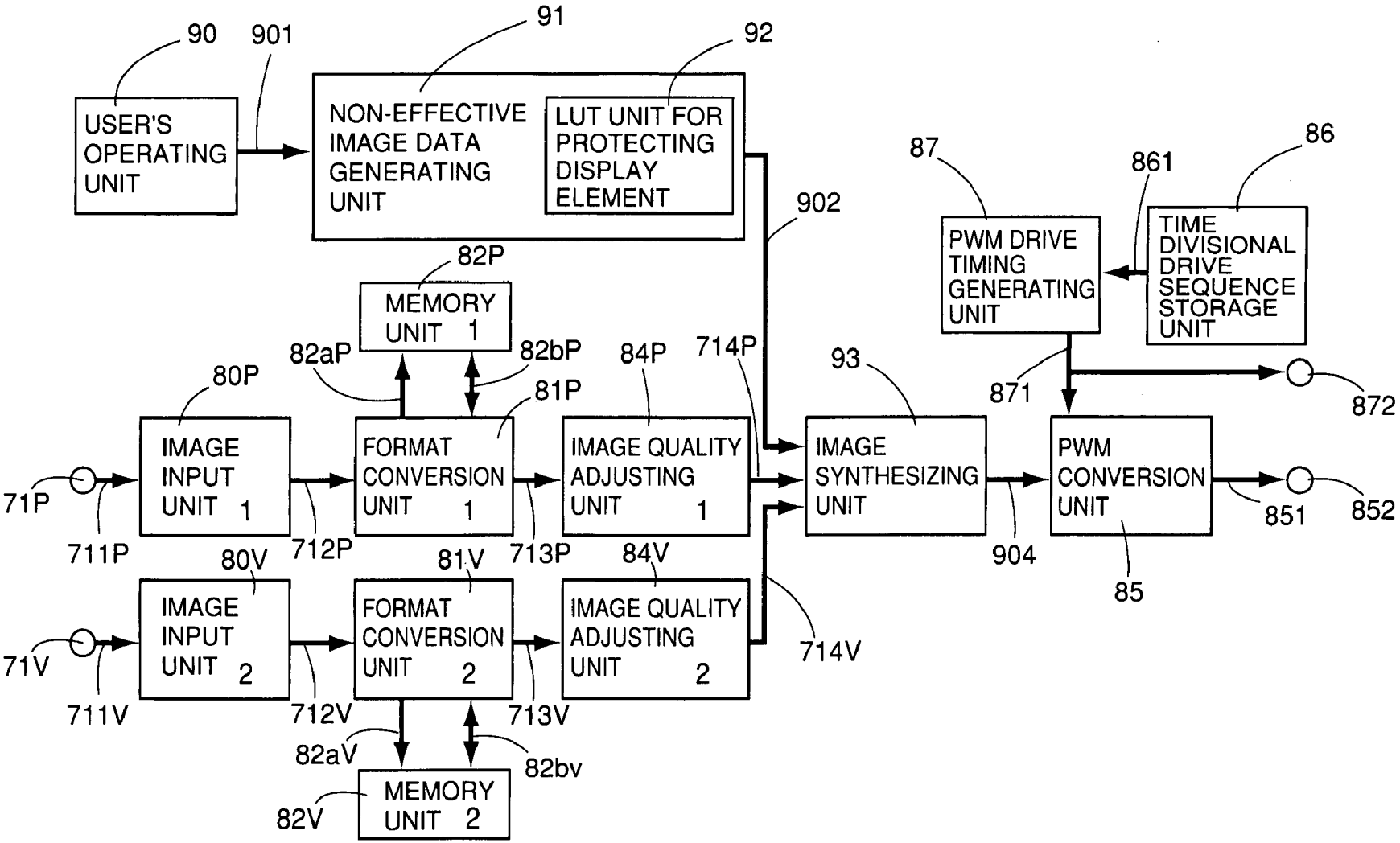
FIG. 12 is a block diagram showing the detailed construction and the like of a signal processing unit.

FIG. 12 is a block diagram showing the detailed construction and the like of the signal processing unit of the present embodiment. In this embodiment, the overall construction of the display apparatus is almost the same as that of the projection-type image display apparatus 1 shown in FIG. 2, although the input unit 7 in FIG. 2 is replaced with two input terminals 71P and 71V in FIG. 12 via which image signals are inputted.

In FIG. 12, reference symbol 71P denotes an input terminal via which an image signal is inputted from the PC, and reference symbol 71V an input terminal via which an image signal is inputted from the digital television tuner.

Also, each of reference symbols 711P, 712P, 713P, and 714P represents a data bus for transmitting the image signal inputted from the PC. Further, each of reference symbols 711V, 712V, 713V, and 714V represents a data bus for transmitting the image signal inputted from the digital television tuner.

Reference symbol 80P denotes an image input unit that is a receiving unit for receiving an image signal sent from the PC. For instance, the image input unit 80P includes a decoder that receives a signal based on a TMDS scheme and decodes the received signals into 24-bit data (three pieces of 8-bit data that respectively correspond to RGB). Here, the TMDS scheme is an image transmission scheme adopted by, for instance, the DVI (Digital Visual Interface) specification published by the standardizing group "DDWG (Digital Display Working Group)".

Also, reference symbol 80V denotes an image input unit that is a receiving unit for receiving an image signal sent from the digital television tuner. For instance, the image input unit 80V includes a decoder that receives a compression signal in an MPEG format via IEEE 1394 and decodes the received compression signal into 24-bit data (three pieces of 8-bit data that respectively correspond to RGB).

Each of reference numerals 81P and 81V represents a format conversion unit that performs resolution conversion, image refresh frequency conversion, non-interlace processing, color matrix conversion, and the like. Here, the resolution conversion means magnification conversion and interpolation processing that are appropriately performed for image signals whose resolutions do not match the numbers of display pixels in the sub-screen areas of the image display unit.

Also, each of reference symbol 82P and 82V represents a memory unit that provides an image storage area used by one of the format conversion units 81P and 81V to perform image processing. Each of reference numerals 82*a*P and 82*a*V indicates a control line group of a corresponding memory unit, and each of reference symbol 82*b*P and 82*b*V a data line group for transferring data between a corresponding memory unit and format conversion unit.

Each of reference symbols 84P and 84V represents an image quality adjusting unit that receives the image signal inputted from the PC and the digital television tuner, which is subjected to the format conversion from one of the format conversion units 81P and 81V and adjusts, according to the control by the microcomputer (not shown), image quality, such as brightness, color characteristics, and gamma characteristics, of images to be displayed on the display unit.

Reference numeral 90 denotes a user's operating unit including the switches provided on the display apparatus and the buttons of the remote controller. Reference numeral 901 represents a data line for transmitting an operation signal. Reference numeral 91 denotes a non-effective image area data generating unit that generates, according to the operation signal, drawing data values to be displayed in the non-effective image area. Reference numeral 92 indicates a LUT (look-up table) unit for protecting display element. The LUT unit 92 converts values set by a user into appropriate values and outputs the appropriate values to prevent a situation where the display element remains in one of binary display states for a long time. The LUT unit 92 for protecting display element is provided in the non-effective image area data generating unit 91. Reference numeral 902 denotes a data bus for transmitting the non-effective image area data converted by the LUT unit 92.

Reference numeral 93 indicates an image synthesizing unit for generating synthesized image data that represents an image of one screen by combining the non-effective image area data with image data for the sub-screen areas sent from the image quality adjusting units 84P and 84V. Reference numeral 904 represents a data bus for transmitting the synthesized image data.

Reference numeral 85 represents a PWM conversion unit for converting an ordinary image signal for sequential scanning into a time divisional display signal by performing the pulse width modulation (PWM), reference numeral 86 a time divisional drive sequence storage unit for storing time divisional drive sequence describing the display order and display time period of the PWM-modulated data, reference numeral 87 a PWM driving timing generating unit for generating, according to the time divisional drive sequence, driving timing used by the PWM conversion unit 85 and -the spatial modulation element (image display unit). Reference numeral 861 denotes a transmission line for transmitting the drive sequence data from the time divisional drive sequence storage unit 86 to the PWM driving timing generating unit 87, and reference numeral 871 a control line group for transmitting a driving pulse generated by the PWM driving timing generating unit 87 and other signals. Also, reference numeral 872 represents an output terminal via which control signals, such as the driving pulse, are outputted to the image display element 2, numeral 851 a data bus for transmitting the image data converted by the PWM conversion unit 85, and numeral 852 an output terminal via which the image data is outputted to the image display element 2.

Here, like in the first and second embodiments, the signal processing unit of the present embodiment includes the input terminals and signal lines for the horizontal synchronizing signal (IHD), vertical synchronizing signal (IVD), and clock signal (ICLK) that are input signals. The signal processing unit of the present embodiment also includes the crystal oscillator and the signal lines for transmitting the horizontal synchronizing signal (OHD) and vertical synchronizing signal (OVD), which are used to establish synchronization after the format conversion processing, and the clock signal (OCLK) generated by the crystal oscillator. However, for ease of explanation, these construction elements are not described here and are not shown in FIG. 12.

Each of FIGS. 13A and 13B shows an example of the look-up table used by the LUT unit 92 for protecting display element. FIG. 13A shows a look-up table applied to chrominance data corresponding to R (red) and G (green), out of three primary color data. On the other hand, FIG. 13B shows a look-up table applied to chrominance data corresponding to B (blue). In these drawings, each of the input data value and output data value for each color is in a range from shade 0 to shade 63 (64 shades of gray).

In FIG. 13A, if the input value corresponding to R and G is in a range from shade 1 to shade 60, the output value becomes the same as the input value, although the output value is restricted not to fall below shade 1 and exceed shade 60. On the other hand, in FIG. 13B, if the input value corresponding to B is in a range from shade 3 to shade 62, the output value becomes the same as the input value, although the output value is restricted not to fall below shade 3 and exceed shade 62.

Consequently, if a user tries to set arbitrary display values in the non-effective image area B6 other than the sub-screen areas to obtain an intended color or gradation value, data conversion is internally performed to protect the display element in the manner described below.

The following description is based on the assumption that the number of shades of each color (red, green, and blue) is 64 ranging from shade 0 to shade 63. In this case, if a user designates the display of a pure black mask using the user's operating unit, input value data (red=shade 0, green=shade 0, blue=shade 0) is inputted into the LUT unit 92, which then outputs an output value (red=shade 1, green=shade 1, blue=shade 3). In this case, the display state of the display element in the non-effective image area becomes as follows. The non-effective image area is placed in an ON state for a time period accounting for 1.6% of the entire display period for red and green and is placed in an OFF state for a time period accounting for 98.4% of the entire display period. Also, the non-effective image area is placed in an ON state for a time period accounting for 4.7% of the entire display period for blue and is placed in an OFF state for a time period accounting for 95.3% of the entire display period. Accordingly, the display element is placed in the ON state for a time period accounting for 2.6% of one field period on average. This prevents a situation where only one of binary display states continues for a long time (the display element is not placed in the ON state at all). Also, according to experimental results and the like, it is found that if the non-effective image area is placed in the ON state for a time period accounting for 20% or more of one field period, this allows the user to easily recognize a situation where the black mask is brightened. In this embodiment, however, by reducing the proportion of the ON state to around 2.6%, the degradation of image quality recognized by the user can be suppressed. In this manner, despite the fact that the black mask in the non-effective image area has a value where black is slightly brightened, the reliability of the apparatus is ensured without significantly degrading image quality by displaying a black mask with a tinge of blue that users somewhat prefer.

If a user designates the display of a mask in pure white using the user's operating unit, input value data (red=shade 63, green=shade 63, blue=shade 63) is inputted into the LUT unit 92, which then outputs an output value (red=shade 60, green=shade 60, blue=shade 62). In this case, the display state of the display element in the non-effective image area becomes as follows. The non-effective image area is placed in an ON state for a time period accounting for 95.3% of the entire display period for red and green and is placed in an OFF state for a time period accounting for 4.7% of the entire display period. Also, the non-effective image area is placed in an ON state for a time period accounting for 98.4% of the entire display period for blue and is placed in an OFF state for a time period accounting for 1.6% of the entire display period. Accordingly, the display element is placed in the OFF state for a time period accounting for 3.7% of one field period on average. This prevents a situation where only one of binary display states continues for a long time (the display element is not placed in the OFF state at all). Here, if the non-effective image area is placed in the OFF state for a time period accounting for 20% or more of one field period, this allows the user to easily recognize the reduced brightness of white. In this embodiment, however, by reducing the proportion of the OFF state to around 3.7%, the degradation of image quality recognized by the user can be suppressed.

In this manner, despite the fact that the non-effective image area has a value where white is slightly darkened, the reliability of the apparatus is ensured without significantly degrading image quality by displaying a white mask with a tinge of blue having a high color temperature that users somewhat prefer.

Also, if a user designates the display of a mask in blue using the user's operating unit, input value data (red=shade 0, green=shade 0, blue=shade 63) is inputted into the LUT unit 92, which then outputs an output value (red=shade 1, green=shade 1, blue-shade=62). In this case, the display state of the display element in the non-effective image area becomes as follows. The non-effective image area is placed in an ON state for a time period accounting for 3.1% of the entire display period for red and green and is placed in an OFF state for a time period accounting for 96.9% of the entire display period. Also, the non-effective image area is placed in an ON state for a time period accounting for around 98.4% of the entire display period for blue and is placed in an OFF state for a time period accounting for 1.6% of the entire display period. In the case of a mono-plate projection-type display apparatus (an example thereof is shown in FIG. 2) adopting a color sequential scheme (color field sequential scheme) where display in each color is performed by time-divisional driving a single image display element, the main display state in the red and green periods and the main display state in the blue period are reversed. As a result, a situation does not arise where the proportion of one of binary display states is extremely increased, which prevents the problem as to reliability. In the case of a tri-plate projection-type display apparatus that uses one display element for each color, the reversal of display states needs to be performed for each color. Therefore, by regulating the proportion of ON/OFF states in the manner described above, the reliability of the apparatus is ensured without significantly degrading image quality.

As described above, if a user can set the color and gradation level in a non-effective image area other than an effective image area, the display period of a reverse display state (in which the non-effective image area is placed only for a very short time period) among the binary display states in the non-effective image area is regulated so as to account for a predetermined proportion of the entire display period. In this manner, the degradation of a display element is prevented and the reliability of a display apparatus is improved.

Here, it is preferable that the proportion of the display period of the reverse display state is set to exceed 0%.

Also, in consideration of image quality, it is preferred that the proportion of the total of effective times of the reverse display state among the binary display states in the non-effective image area is set to exceed 0% but not to exceed 20%.

In this embodiment, a look-up table is used to regulate the total effective time of the reverse display state in the non-effective image area among the binary display states in the non-effective image area so as to account for a predetermined proportion of the entire display period. However, a limiter circuit that converts an input value that exceeds or falls below a predetermined value into an appropriate output value may be used instead of the look-up table. Also, a calculation circuit that performs calculation for a value set by a user and determines an output value may be used instead of the look-up table. That is, any other means may be used instead of the look-up table so long as it is possible to regulate the display state of a display element.

In the aforementioned embodiments, a situation where a non-effective image area continuously remains in a dark display state is avoided by reversing the dark display state into a bright display state (non-dark display state) for a very short time period. This suppresses the degradation of an image display element, improves the reliability and life span of a product, and prevents the degradation of image quality. In more detail, in the case of an MEMS element, the degradation of micromechanical characteristics, such as hinge storage, is prevented.

As described above, according to the invention of the present application, the degradation of construction elements of an image display apparatus is suitably suppressed.

What is claimed is:

1. An image display apparatus comprising;

an image signal generating unit for generating an image signal; and an image display element for displaying an image on a screen according to the image signal inputted from said image signal generating unit, said image display element having a plurality of modulation target units, wherein, when the screen and an image to be displayed are different in aspect ratio, all of said modulation target units substantially within a non-effective image area set at least at upper or lower sides or right or left sides of the screen are operated a plurality of times from a start of displaying until an instruction to terminate an operation by a user.

2. An image display apparatus according to claim 1, wherein said plurality of modulation target units are arranged two-dimensionally.

3. An image display apparatus according to claim 1, wherein said image display element performs binary display.

4. An image display apparatus according to claim 1, wherein the image is displayed by sequentially irradiating said image display element with light in various colors and switching images in the colors displayed by said image display element in synchronization with the light irradiation, and the operation of said modulation target units within the non-effective image area is performed in a display period assigned to a specific color.

5. An image display apparatus according to claim 1, wherein said image display element performs binary display, and the operation of said modulation target units within the non-effective image area is performed for a signal corresponding to a low gradation.

6. An image display apparatus according to claim 1, wherein the operation of said modulation target units within the non-effective image area is cyclically performed at a frequency lower than a screen refresh frequency of said image display element.

7. An image display apparatus according to claim 1, wherein the operation of said modulation target units within the non-effective image area is cyclically performed at a frequency of 50 Hz or higher.

8. An image display apparatus according to claim 1, wherein the image signal transmitted from said image signal generating unit to said image display element is a pulse-width-modulated signal, and said image display element is driven by the pulse-width-modulated signal and displays a gradation image.

9. An image display apparatus according to claim 1, wherein said image display element is a spatial modulation element that uses a liquid crystal.

10. An image display apparatus according to claim 1, wherein said image display element is a spatial modulation element of an MEMS type.

11. An image display apparatus according to claim 1, wherein said image display element is a spatial modulation element in which micromirrors are arranged.

12. An image display apparatus according to claim 1, wherein said image display element is an LED.

13. An image display apparatus according to claim 1, wherein said image display element is a display element of a self light emitting type.

14. An image display apparatus according to claim 1, wherein a single time of the operation of the modulation target units substantially within a non-effective image area is performed during 173 μs or longer.

* * * * *

UNITED STATES PATENT AND TRADEMARK OFFICE

CERTIFICATE OF CORRECTION

It is certified that error appears in the above-identified patent and that said Letters Patent is hereby corrected as shown below:

COLUMN 6:

Line 9, “prevent” should read --present--.

COLUMN 14:

Line 38, “prevent” should read --present--.

COLUMN 18:

Line 59, “173

ERROR: undefined
OFFENDING COMMAND: S

STACK: